US010221050B2

(12) United States Patent
Weterings et al.

(10) Patent No.: US 10,221,050 B2
(45) Date of Patent: Mar. 5, 2019

(54) CRANE VESSEL

(71) Applicant: ITREC B.V., Schiedam (NL)

(72) Inventors: Hendrikus Jacobus Weterings, 's-Gravenzande (NL); Joop Roodenburg, Delft (NL)

(73) Assignee: ITREC B.V., Schiedam (NL)

( * ) Notice: Subject to any disclaimer, the term of this patent is extended or adjusted under 35 U.S.C. 154(b) by 819 days.

(21) Appl. No.: 14/615,914

(22) Filed: Feb. 6, 2015

(65) Prior Publication Data

US 2015/0151953 A1 Jun. 4, 2015

Related U.S. Application Data

(63) Continuation-in-part of application No. PCT/NL2013/050576, filed on Aug. 2, 2013.

(30) Foreign Application Priority Data

Aug. 6, 2012 (NL) ..... 2009287
Apr. 26, 2013 (NL) ..... 2010721

(51) Int. Cl.
*B66C 23/52* (2006.01)
*B66C 13/08* (2006.01)

(52) U.S. Cl.
CPC ..... *B66C 23/52* (2013.01); *B66C 13/08* (2013.01)

(58) Field of Classification Search
CPC ..... B66C 23/00; B66C 23/06; B66C 23/16; B66C 23/163; B66C 23/166; B66C 23/18;
(Continued)

(56) References Cited

U.S. PATENT DOCUMENTS 2,709,526 A * 5/1955 Hansen ..... B66C 3/00 212/243
2,933,197 A 4/1960 Fox
(Continued)

FOREIGN PATENT DOCUMENTS

CN 201074168 Y 6/2008
CN 101652313 A 2/2010
(Continued)

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

The present invention relates to a crane vessel and a method of lowering an object from such a crane vessel into the sea. The crane comprises a stationary pedestal, a crane housing that is adapted to slew relative to the pedestal about a vertical rotation axis and a boom, comprising an inner end which is connected pivotably about a horizontal pivot axis to the crane housing. A luffing device extends between the boom and the crane housing, adapted to position the boom and actuate the up-and-down movement of the boom. Furthermore an object suspension device is provided to which an object is connectable, and a hoist assembly which comprises a winch and an associated hoisting cable, the hoisting cable extending from the winch, via a departing sheave on the boom, to the object suspension device, such that upon actuation of the winch the object suspension device can be raised and lowered, wherein the one or more portions of the hoist cable between the boom and the object suspension device form one or more suspension cable parts. According to an aspect of the invention, a hoist cable guide is provided which, at an operational position thereof, is adapted to guide at least one of the suspension cable parts between the boom and the object suspension device. According to another aspect of the invention, the hoisting cable is provided as a multiple fall cable and a hoist cable retention device is
(Continued)

provided on the boom. The hoisting cable comprises one or more first suspension cable parts extending between the object suspension device and a radially outward location of the boom, and one or more second suspension cable parts extending between the objection suspension device and a radially inward location, such that the first and second suspension cable parts extend at V-shape with respect to each other, at an angle of preferably between 20 and 60°.

22 Claims, 22 Drawing Sheets

(58) Field of Classification Search
CPC ..... B66C 23/36; B66C 23/42; B66C 23/52; B66C 23/525; B66C 23/60; B66C 23/605; B66C 23/62; B66C 23/64; B66C 23/66; B66C 23/68; B63B 27/10; B63B 27/36; B63B 23/04
USPC ..... 114/98, 268, 373
See application file for complete search history.

(56) References Cited

U.S. PATENT DOCUMENTS

| | | | | |
|---|---|---|---|---|
| 3,062,383 | A | 11/1962 | Claesson | |
| 3,378,158 | A * | 4/1968 | Lopez | E02F 3/47 254/361 |
| 3,591,022 | A | 7/1971 | Polyakov et al. | |
| 3,885,676 | A * | 5/1975 | Wilson | B66C 1/663 212/167 |
| 4,227,676 | A * | 10/1980 | Vaillant | B66C 13/06 212/274 |
| 4,266,680 | A | 5/1981 | Velikoselsky et al. | |
| 4,892,202 | A | 1/1990 | Hey et al. | |
| 2010/0294737 | A1* | 11/2010 | Roodenburg | B66C 23/52 212/294 |
| 2011/0094987 | A1* | 4/2011 | Botwright | B66C 1/108 212/274 |

FOREIGN PATENT DOCUMENTS

| | | |
|---|---|---|
| WO | WO-2005/123566 A2 | 12/2005 |
| WO | WO 2008/100137 A2 | 8/2008 |

* cited by examiner

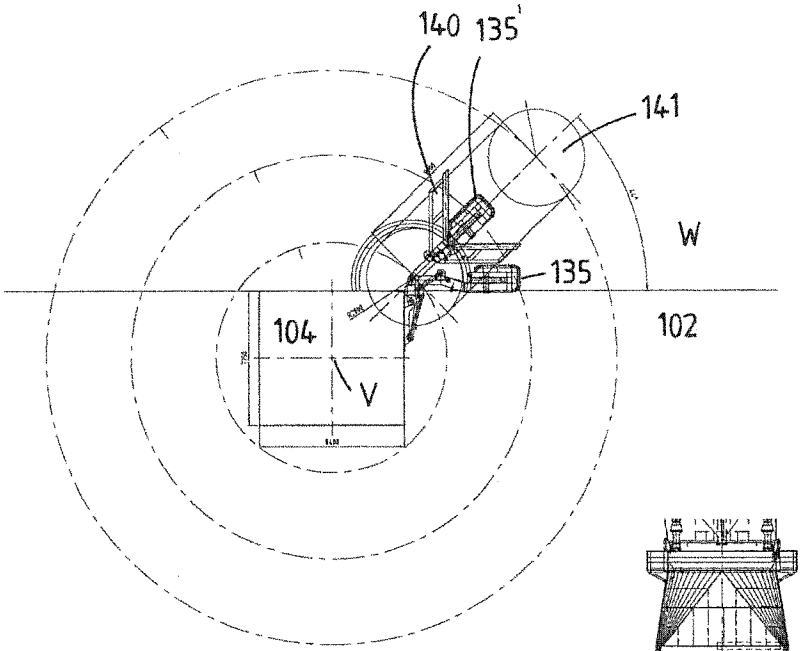
Fig.10a
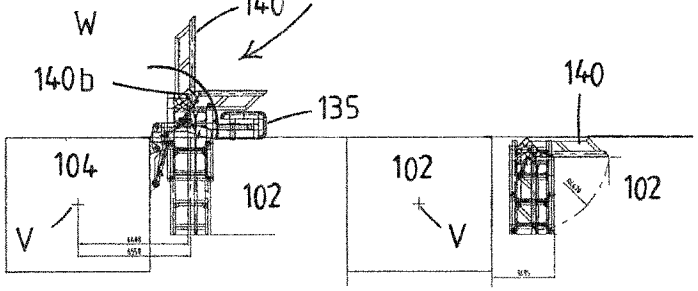
Fig.10b
Fig.10c
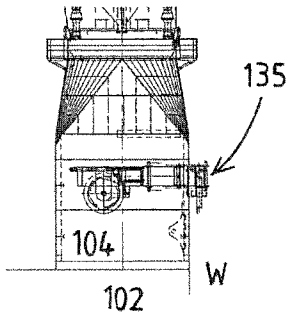
Fig.10d
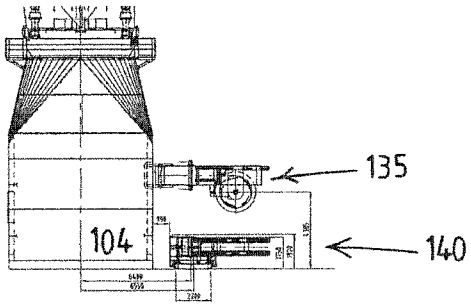
Fig.10e

CRANE VESSEL

CROSS REFERENCE TO RELATED APPLICATIONS

This non-provisional application is a Continuation-In-Part of International Application No. PCT/NL2013/050576 filed on Aug. 2, 2013, which claims priority under 35 U.S.C. 119(a) to Netherlands Patent Application Nos. 2009287 filed on Aug. 6, 2012, and 2010721 filed on Apr. 26, 2013, all of which are hereby expressly incorporated by reference into the present application.

The present invention relates to a crane vessel and a method of lowering an object from such a crane vessel into the sea, e.g. as part of a lowering procedure of the object onto the seabed, e.g. at a depth of 300 meters or more. A prior art crane vessel, e.g. as disclosed in WO2005123566 of the same applicant, comprises a hull and a crane, wherein the crane comprises:

- a stationary pedestal, mounted to or formed integral with the hull of the vessel;
- a crane housing that is adapted to slew relative to the pedestal about a vertical rotation axis,
- a boom, comprising an inner end which is connected pivotably about a horizontal pivot axis to the crane housing, allowing an up-and-down movement of the boom, and comprising a departing sheave,
- a luffing device extending between the boom and the crane housing, adapted to position the boom and actuate the up-and-down movement of the boom,
- an object suspension device to which the object is connectable,
- a hoist assembly which comprises a winch and an associated hoisting cable, the hoisting cable extending from the winch, via a departing sheave on the boom, to the object suspension device, such that upon actuation of the winch the object suspension device can be raised and lowered, wherein the portion of the hoist cable between the boom and the object suspension device forms one or more suspension cable parts.

Objects can be lowered into the sea from such a crane vessel, i.e. lowered overboard from the crane vessel into the water, e.g. lowered onto the seabed, e.g. to a depth of 300 meters or more, by the following steps:

- positioning the object suspension device above the object,
- engaging the object by the object suspension device and actuating the hoist winch to lift the object,
- positioning the object in an overboard position by slewing the crane housing and/or actuating the luffing cable,
- lowering the object overboard and into the sea by actuating the hoist winch.

Such a crane vessel is commonly known in the art, and the lowering method of an object overboard into the sea is commonly applied in the art. The aim of the present invention is to provide an improved crane vessel and method.

This is accomplished according to a first aspect of the present invention by providing the crane vessel furthermore with a hoist cable guide which, at an operational position thereof, is adapted to guide at least one of the suspension cable parts between the boom and the object suspension device. Accordingly, the method according to the first aspect of the present invention involves an additional step of bringing a suspension cable part of the hoisting cable into engagement with the hoist cable guide, preferably when the object is lowered below sea level, in particular below the hull of the vessel, and guiding at least one of the suspension cable parts by the hoist cable guide in its operational position.

An advantage of this guiding of a suspension cable part by the hoist cable guide is that the point of engagement by the guide can be close to the hull of the vessel, in particular close to the motion center of the vessel. As a result of the state of the sea, the vessel moves about this motion center: so-called sea-state induced vessel motions. The sea-state induced vessel motions cause the boom to move, and thus the departing sheave of the boom, the amount of which may be to several meters in vertical direction. The closer to this motion center, the less the extent of sea-state induced vessel motions.

In the prior art every suspension cable part is suspended from the boom. A heave compensator system is commonly provided to compensate for the sea-state induced vessel motions, which may thus have to compensate several meters. According to the first aspect of the invention, a point of engagement is at the operational position of the hoist cable guide, which is between the boom and the object suspension device. By providing this point of engagement relatively close to the motion center of the vessel, the suspension cable part is less influenced by sea-state induced vessel motions. As a result, the compensation that may be provided by a heave compensator is relatively reduced.

Another advantage of guiding at least one suspension cable part between the boom and the object suspension device is that the point of engagement of the suspension cable part with the crane vessel is lower. The closer the point of engagement to the center of gravity, the better the improvement of the stability of the crane vessel.

The object to be lowered is thus first engaged, lifted, positioned and lowered in the aerial phase, and subsequently lowered into the sea. Once under water, this is referred to as the subsea phase. The subsea phase thus starts when the object has just been lowered under water, and may take until the object is on the bottom of the sea. The hoist cable guide and its use of guiding a suspension cable part according to the first aspect of the invention is advantageous in this subsea phase. The engagement of suspension cable part with the hoist cable part preferably occurs when the object is lowered below sea level, in particular below the hull of the vessel.

The crane vessel according to both aspects of the present invention is particularly but not exclusively for use in connection with lifting equipment employed for offshore purposes, in particular in the oil industry. Subsea activities of the oil industry are taking it into even deeper water and consequently lifting of heavy equipment and pipes has to be accomplished at a much greater depth than hitherto. Such depths are generally around 3000 meters or more.

Such oil industry activities may include positioning an object on the sea floor from a floating vessel, lift and shift operations off the sea floor, where a heavy load has previously been laid or wet stored on the sea floor to be subsequently lifted and moved to a new location without being taken out of the water, or positioning an unlaid end portion of a pipe that is being laid on the sea floor, or recovering to the floating vessel the end of the pipe lying on: the sea floor, in other words, the lay down, abandonment and recovery of objects, such as oil conveying pipes, pipeline end terminations (PLETs), manifolds and the like, particularly during or at the end of the process of laying such pipes from a pipe laying vessel onto the sea floor. For example the object is a subsea template to be installed on the seabed. The term "abandonment and recovery" is often abbreviated to "A&R".

The crane vessel according to both aspects of the invention is used for offshore lifting and lowering operations, in particular the deployment of objects into the water. The crane vessel can be a monohull vessel, or a catamaran vessel, or any other type of vessel. It is even conceivable that the vessel is, or can act as an offshore platform. The vessel preferably comprises a deck, onto which objects to be lowered or raised can be positioned. It is also conceivable that the objects to be lowered or raised are positioned in the hull of the vessel, or on another vessel or floating object, which is positioned adjacent the crane vessel, or even on land.

The hoist assembly according to both aspects of the invention preferably comprises a deep water winch and an associated deep water cable for raising and lowering an object. Preferably, such deep water winch and cable allow the lowering of subsea structures to water depths of at least 1000 meters, more preferably up to 3000 meters.

Such deep water winch and deep water cable may preferably be embodied as an abandonment and recovery (A&R) winch and cable. Such A&R winch and cable is used in pipe lay operations to be able to abandon and recover a previously launched pipeline. For such purposes, it is required that the entire weight of the previously launched pipeline is suspended from an A&R wire.

The winch, in particular when used to lower in deep water, may be embodied as a linear winch, or a traction winch, or any other suitable type of winch. Preferably, the winches of the hoist assembly are fitted outside the crane housing since they require a large storage capacity for ultra deep lifts. Preferably, the winch, and associated or integrated storage drum for the hoisting cable is positioned in the hold of the vessel. Preferably, the winch and associated or integrated storage drum, in particular a deep water winch, is positioned as low as possible due to its large weight.

The hoisting cable used on the crane vessel according to both aspects of the invention may, as most of the lifting equipment currently in use on offshore construction vessels, employ a massive steel cable or steel wires as a lifting medium. To handle the objects involved (250 tonnes or more) these wires are necessarily large and heavy.

Alternatively, fibre ropes can be used, which can be made from natural or synthetic fibers, in particular polymer fibers, which weight little or nothing when immersed in water. Possibly, aromatic polyamids (aramids) are applied, such as Twaron, Kevlar and Nomex, which thermally degrade at high temperatures and do not melt. These fibers have strong bonding between polymer chains, resulting in a high-performance man-made fiber. The material of the cable may be dependent from environmental conditions. It is conceivable that in some instances, electrical signal conductors, optical conductors etc. may form part of the cable, such as for example in umbilical cables.

According to both aspects of the invention, a stationary pedestal is mounted to or formed integral with the hull of the crane vessel. In particular, the pedestal is preferably mounted on deck of the vessel, but it is also conceivable that the pedestal is formed integral with a portion of the hull and possibly the deck of the vessel, which may improve the overall stability of the crane.

According to both aspects of the invention, a crane housing is provided, that is adapted to slew relative to the pedestal about a vertical rotation axis, e.g. via a rotating bearing. In a possible embodiment, the lower portion of crane housing is bolted via a slew bearing to the pedestal.

In a possible embodiment, according to both aspects of the invention, the pedestal is embodied as a fixed mast, and the crane housing is embodied as the combination of a rotating slew platform supporting the boom and a rotatable mast head at the top of the mast. Thus, both the slew platform supporting the boom and the mast head are provided rotational relative to the fixed mast (pedestal) about a vertical rotation axis. The hoisting cable is allowed to run from the mast head or the rotating slew platform to the departing sheave of the boom. Also the luffing cable is allowed to run from the mast head to the main boom, to control the position of the main boom. Such a mast construction gives an inherent safety feature; the load moment is carried by the mast and not by the slew bearings.

Furthermore, according to both aspects of the invention, the crane comprises a boom, comprising an inner end which is connected pivotably about a horizontal pivot axis to the crane housing, allowing an up-and-down movement of the boom, and comprising a departing sheave. As a result of the slewing motion of the crane housing, rotation of the boom in a horizontal plane is allowed. Preferably, the crane housing is allowed to rotate over 360°, such that the boom has a 360° reach, to have a large reach area of the crane from a position above deck, such that an object can be engaged, to a position above the water, into which the object can be lowered.

According to both aspects of the invention, the boom is rotatable about a horizontal pivot axis with respect to the crane housing, allowing an up- and downward movement of the boom. This movement is actuated by a luffing device, which is provided in order to position the boom. The luffing device, which can e.g. comprise a cable or a cylinder, extends between the boom and the crane housing.

According to both aspects of the invention, the boom can comprise a single boom or jib. Alternatively, the boom can comprise multiple articulated boom sections.

In a particular embodiment of both aspects of the invention, the boom is embodied as a knuckle boom, comprising a main boom and a jib. The main boom comprises the inner end of the boom, which is connected pivotably about a first horizontal pivot axis to the crane housing; the main boom further comprising a central area and an outer end. The departing sheave is provided on the jib. The jib comprises a tip of the boom, and further a central area and an inner end opposite the tip. The inner end of the jib is connected pivotably about a second horizontal pivot axis to the outer end of the main boom. As is characteristic for a knuckle boom crane, the boom articulates at the 'knuckle' near the middle, letting it fold back like a finger, thus creating the so-called knuckle boom. This provides a compact size for storage and maneuvering. Thus, the jib is pivotable at least between an extended position in which the departing sheave extends mainly forward from the main boom, and a folded position in which the jib is folded back along the main boom.

The knuckle boom crane has been particular advantageous for marine purposes as the 'folded back finger' of the crane allows the crane to hoist objects with the departing sheave of the jib close to the vessel, in particular to the deck of the vessel. This way, movements of the object can be limited as the departing sheave of the jib can be kept at a limited height above deck. Also, as the force of the object is introduced at a lower point of the crane, the stability of the vessel is increased. These features makes the crane safe and efficient.

To operate the knuckle boom, both parts of the boom, the main boom and the jib, are individually controlled. The luffing device generally controls the main boom. Conventionally hydraulic cylinders are used, in particular for knuckle boom cranes capable of hoisting objects from a few thousand kilos up to objects up to 50 tons.

Alternatively, according to another invention of the same applicant, in order to position the jib with respect to the main boom, a tensioning member and a curved extension guide are provided, the tensioning member extending between the crane housing and the curved extension guide, and the curved extension guide being connected to the jib and being pivotable together with the jib about the second pivot axis, and guiding a portion of the tensioning member, wherein a second winch allows to vary the length of the tensioning member and thus to position the jib.

According to both aspects of the invention, an object suspension device is provided to which the object can be connected. In general, the device comprises a hook or the like.

According to both aspects of the present invention, the hoist assembly may comprise multiple falls. To guide the falls of the hoisting cable, the object suspension device preferably comprises at least one sheave or pulley to guide the hoisting cable. A double fall hoist assembly requires a single sheave or pulley at the object suspension device. A multiple fall hoist assembly requires opposite blocks in which multiple sheaves are arranged to guide the falls of the hoisting cable, preferably provided at the object suspension device and at boom, preferably the tip of the boom.

Furthermore, additional sheaves or pulleys or other cable guides may be provided to guide the hoisting cable from the winch, to the boom.

In an embodiment of the first aspect of the invention, the hoisting cable is provided as a single fall cable, for example adapted to lower onto the seabed, e.g. more than 300 meters deep. In such an embodiment, the hoisting cable extends from the winch, via the departing sheave on the boom, to the object suspension device. The portion of the hoist cable between the departing sheave and the object suspension device forms the single suspension cable part. The hoist cable guide is, at the operational position thereof, adapted to guide this suspension cable part.

In an alternative embodiment of the first aspect of the invention, the hoisting cable is provided as a multiple fall cable comprising one or more first suspension cable parts extending between the object suspension device and a radially outward location of the boom, and one or more second suspension cable parts extending between the objection suspension device and a radially inward location of the boom. In this embodiment, the hoist cable guide, at the operational position thereof, is adapted to guide one or more second suspension cable parts. In a preferred embodiment, the one or more departing sheaves of the boom are provided at the radially outward location. A hoist cable retention device is provided on the boom, between the inner end of the boom and the radially outward location.

The hoist cable retention device may be provided with one or more sheaves, or alternatively a dead end connection point for the hoist cable may be provided.

Another advantage of the first aspect of the invention is that by engaging the one or more second suspension cable parts by means of the guide in such a multiple fall arrangement, the angle between the first and second suspension cable parts can be enlarged. This increased angle between the suspension cable parts allows to prevent entanglement of the hoisting cable, a phenomenon also known as rope or wire twisting. The larger the angle, the better the entanglement prevention.

As elucidated above, it is advantageous for the hoist cable guide, at the operational position thereof, and thus the point of engagement of the suspension cable part with the crane vessel, to be provided close to the motion center of the vessel and close to the center of gravity of the vessel. As advantages are significant even when the hoist cable guide is provided at some distance from the motion center and the center of gravity, there is a favorable area of locations of the hoist cable guide. In a possible embodiment, in the operational position, the hoist cable guide is positioned in vertical direction essentially between the horizontal pivot axis of the boom and the bottom of the hull, and in a direction transverse to the vessel within 5 meters of a side of the hull, and in longitudinal direction alongside the hull of the vessel.

In the operational position, the hoist cable guide may be connected e.g. to the pedestal of the crane, the crane housing, or to the hull of the vessel, etc. For example, the vessel may be provided with a deck onto which the hoist cable guide is connected. Possibly, but not necessarily, the hoist cable guide is positioned outside of the hull in operational position, seen in top view.

According to the method of the first aspect of the invention, a suspension cable part should be brought into engagement with the hoist cable guide, after which the hoist cable guide is adapted to guide the at least one of the suspension cable part. Possibly, the hoist cable guide is embodied as a sheave, a wire guide, a pulley, etc. In a possible embodiment, the hoist cable guide has an open configuration allowing the at least one suspension cable part to be brought in engagement with the hoist cable guide, which open configuration also allows the guidance of the at least one suspension cable part according to the first aspect of the present invention.

In a possible embodiment, the hoist cable guide is adapted to transform between an open configuration allowing the at least one suspension cable part to be brought in engagement with the hoist cable guide and a closed configuration in which the at least one suspension cable part is guided by the hoist cable guide and cannot become separated from the hoist cable guide.

As indicated above, the method according to the first aspect of the present invention involves the step of bringing a suspension cable part of the hoisting cable into engagement with the hoist cable guide. This may be achieved by causing the suspension cable part to move towards the hoisting cable guide, e.g. by slewing the crane, or by causing the hoisting cable guide to move towards the suspension cable part, or a combination thereof.

A preferred method comprises the step of slewing the crane housing and/or of actuating the luffing cable to bring a suspension cable part of the hoisting cable into engagement with the hoist cable guide. Slewing the crane causes the suspension cable part to perform a rotational movement about the vertical rotation axis of the crane housing, resulting in a movement essentially perpendicular to the hull in the vicinity of the hull. Actuating the luffing cable causes the suspension cable part to perform a radial movement, towards and away from the crane housing. As such, the suspension cable part can be brought to any position within the range of the crane.

The hoist cable guide according to the first aspect of the present invention is used at an operational position thereof during lowering objects from the crane vessel, and most preferably during the subsea lowering thereof to the seabed, e.g. to depths over 300 meters. During other operations, and for example also during sailing, it may be advantageous to move the hoist cable guide away from its operational position. Possibly, the hoist cable guide can be brought into its operational position by the crane. Alternative means to mount the hoist cable guide to the vessel are also conceivable.

In a possible embodiment, the hoist cable guide is provided movable relative to the hull of the vessel. It is conceivable that the hoist cable guide is movable between the operational position and a storage position, wherein the hoist cable guide can be stored during other operations. In addition, or alternatively, it is also conceivable that the hoist cable guide, while guiding at least one of the suspension cable parts, is movable from one operational position to another operational position. Yet alternatively, the hoist cable guide may be movable from the operational position to a non-operational position in which no suspension cable part is being guided. According to a possible method of the first aspect of the invention wherein the hoist cable guide is movable, the suspension cable part is brought into engagement with the hoist cable guide by moving the hoist cable guide to the operational position. Yet alternatively, the suspension cable part may be brought into engagement with the hoist cable guide at an engagement position of the hoist cable guide, and the hoist cable guide with the engaged cable suspension part is subsequently allowed to move to the operational position. A movable hoist cable guide is in particular advantageous when due to sea-state induced vessel motions, it is difficult to bring the suspension cable part exactly to the operational position of the hoist cable guide.

In an embodiment, a hoist cable guide drive is provided, which is adapted to move the hoist cable guide to an engagement position, remote from the operational position, and which is also adapted to move the hoist cable guide and the engaged suspension cable part from the engagement position to the operational position. Such a drive may allow translations of the hoist cable guide within a horizontal plane, but alternatively a sophisticated hoist cable guide drive allowing movements in all directions is also conceivable. Possibly, the hoist cable guide drive comprises one or more hydraulic cylinders. Alternatively, the hoist cable guide drive comprises a hoist assembly comprising one or more winches and hoist wires. With such a hoist cable guide drive, the suspension cable part may in a possible method according to the first aspect of the invention be brought into engagement with the hoist cable guide by:

- actuating the hoist cable guide drive to move the hoist cable guide to the engagement position until the hoist cable guide reaches the suspension cable part,
- engaging the suspension cable part with the hoist cable guide,
- moving the hoist cable guide and the engaged suspension cable part from the engagement position to the operational position.

In a possible embodiment of a movable hoist cable guide, the hoist cable guide is connected to a guide hoist and a guide tugger. The guide hoist comprises a boom portion extending between the boom and the hoist cable guide, which boom portion extends radially outwards of the suspension cable part which is or is to be engaged by the hoist cable guide. The guide tugger originates from the operational position of the hoist cable guide. Both the guide hoist and the guide tugger can preferably be hauled in and paid out by actuating associated winches. According to this embodiment, by actuating the guide hoist and the guide tugger the hoist cable guide can move between a position adjacent the boom and the operational position of the hoist cable guide wherein the hoist cable guide is adapted to guide a suspension cable part. In a possible method, prior to engaging the object by the object suspension device, the guide hoist is actuated to move the hoist cable guide to the position adjacent the boom, and after the object has been lowered overboard, the guide tugger is actuated to move the hoist cable guide to the operational position, to bring the suspension cable part of the hoisting cable into engagement with the hoist cable guide.

In an alternative embodiment, the hoist cable guide is provided on a hoist cable guide carriage engaging on a hoist cable guide track which is provided along the hull of the vessel and extending essentially parallel to the longitudinal axis of the vessel. A hoist cable guide drive is adapted to translate the hoist cable guide carriage along the hoist cable guide track. According to a possible method according to a first aspect of the invention, the hoisting cable is brought into engagement with the hoist cable guide by:

- slewing the crane housing such that the suspension cable part of the hoisting cable moves towards the hull of the vessel, until the suspension cable part is adjacent the hoist cable guide track,
- actuating the hoist cable guide drive to translate the hoist cable guide until the hoist cable guide reaches the suspension cable part,
- engaging the suspension cable part with the hoist cable guide.

Optionally, the hoist cable guide with the engaged suspension cable part may subsequently be allowed to translate along the hoist cable guide track. As such, the hoist cable guide may translate to the operational position, or possibly between alternative operational positions.

Instead of, or in addition to a movable hoist cable guide, in a possible embodiment, in the vicinity of the hoist cable guide a hoist cable receiver is provided, which is adapted to receive the suspension cable part and allows the suspension cable part to slide to the hoist cable guide. Such a hoist cable receiver is in particular advantageous when due to sea-state induced vessel motions, it is difficult to bring the suspension cable part exactly to the operational position of the hoist cable guide. The receiver allows the suspension cable part to be moved by the crane in one direction, e.g. the rotational movement, until the cable part is stopped by the receiver, and by subsequently performing the opposite movement by the crane, in the example the radial movement, thereby allowing the suspension cable part to be slided towards the hoist cable guide. As such, the movement of the suspension cable part is controlled and brought accurately to the hoist cable guide.

According to a method according to a first aspect of the present invention, the suspension cable part is brought into engagement with the hoist cable guide by:

- providing the hoist cable receiver in an operational position,
- slewing the crane housing and/or actuating the luffing cable to bring the suspension cable part of the hoisting cable into engagement with the hoist cable receiver,
- slewing the crane housing and/or actuating the luffing cable to allow the suspension cable part to be slided along the hoist cable receiver to the hoist cable guide,
- engaging the suspension cable part with the hoist cable guide.

Optionally, a hoist cable guide drive and/or a hoist cable receiver drive may subsequently move the hoist cable guide with the engaged suspension cable part.

In a possible embodiment, the hoist cable receiver extends in a radial direction of the crane housing. This is advantageous as the hoist cable receiver is adapted to receive the suspension cable part by rotating the crane housing, as a result of which the suspension cable part is slewed against the hoist cable receiver. A subsequent actuation of the luffing cable is sufficient to translate the suspension cable part along the hoist cable receiver. Alternative embodiments wherein the hoist cable receiver comprises a longitudinal axis extending in a horizontal plane, e.g. essentially parallel to the hull of the vessel are also conceivable.

Possibly, the hoist cable receiver comprises a funnel-shaped portion, comprising a wide end which is adapted to receive the suspension cable part, and an opposite narrow end which is provided in the vicinity of the hoist cable guide.

When lowering the object, and for example also during sailing, it may be advantageous to remove the hoist cable receiver. Possibly, the hoist cable receiver can be brought into its operational position by the crane. Alternative means to install and remove the hoist cable receiver are also conceivable. In a possible embodiment, the hoist cable receiver is movable by a hoist cable receiver drive. It is conceivable that the hoist cable receiver is movable between an operational position and a storage position, wherein the hoist cable receiver can be stored during other operations.

The present invention also relates to a crane vessel comprising a hull and a crane, wherein the crane comprises:

- a stationary pedestal, mounted to or formed integral with the hull of the crane vessel;
- a crane housing that is adapted to slew relative to the pedestal about a vertical rotation axis,
- a boom, comprising an inner end which is connected pivotably about a horizontal pivot axis to the crane housing, allowing an up-and-down movement of the boom, and comprising a departing sheave,
- a luffing device extending between the boom and the crane housing, adapted to position the boom and actuate the up-and-down movement of the boom,
- an object suspension device to which an object is connectable,
- a hoist assembly which comprises a winch and an associated hoisting cable, the hoisting cable extending from the winch, via a departing sheave on the boom, to the object suspension device, such that upon actuation of the winch the object suspension device can be raised and lowered, wherein the one or more portions of the hoist cable between the boom and the object suspension device form one or more suspension cable parts, and wherein the hoisting cable is provided as a multiple fall cable.

Such crane vessels are well known in the art. When a multiple fall hoist cable is used, a general problem is that the falls of the hoisting cable can get entangled, a phenomenon also referred to a rope or wire twisting.

This problem is solved according to a second aspect of the present invention by a hoist cable retention device which is provided on the boom. The hoisting cable comprises one or more first suspension cable parts extending between the object suspension device and a radially outward location of the boom, and one or more second suspension cable parts extending between the objection suspension device and a radially inward location, such that the first and second suspension cable parts extend at V-shape with respect to each other, at an angle of preferably between 20 and 60°.

It is both conceivable that the hoist cable retention device is provided at the radially inward location of the boom and the departing sheave is provided at the radially outward location, or vice versa, i.e. that the hoist cable retention device is provided at the radially outward location of the boom and the departing sheave is provided at the radially inward location.

The hoist assembly may comprise two falls, resulting in a single first suspension cable part and a single second suspension cable part. Also four falls are conceivable, e.g. comprising parallel 'first suspension cable parts' and 'second suspension cable parts'. Alternative configurations wherein for example one fall can be considered the second suspension cable part, and multiple falls are considered the first suspension cable part are also conceivable.

According to a preferred embodiment of the second aspect of the invention, the hoisting cable extending from the winch may have a dead end or an end connected to another winch. It is conceivable that two winches are provided, and that the hoisting cable extends from one winch, via the boom, via the object suspension device, possibly via a hoist cable guide, and via the hoist cable retention device to the second winch. Alternatively, the hoist cable has a dead end, connected to a dead end connection point. This point may be provided anywhere on the boom, or the crane housing, or even in the hull or on deck of the vessel. In an embodiment, the hoist cable retention device may be embodied as the dead end connection point. As such, the hoisting cable extends from the winch, via the boom, via the object suspension device, possibly via a hoist cable guide, to the hoist cable retention device, and is connected thereto.

According to the second aspect of the present invention, a hoist cable retention device is provided on the boom. The hoist cable retention device allows the first and second suspension cable parts extend at V-shape with respect to each other, at an angle of preferably between 20 and 60°, but it is noted that angles of 5-120° are also possible.

As indicated above, the hoist cable retention device according to the second aspect of the invention may in a certain embodiment be a dead end connection point. Alternatively, the hoist cable retention device can be a sheave or any type of hoist cable guide. In the case of a knuckleboom assembly, the hoist cable retention device is possibly provided at the second pivot axis, between the main boom and the jib.

In a preferred embodiment according to the second aspect of the invention, the angle between the first and second suspension cable parts is adjustable, at a given position of the inner end of the boom and the object suspension device. Of course, the angle will inevitably change upon lowering or raising the object suspension device. In addition, upon actuating the luffing device the angle will also inevitably change. According to the preferred embodiment, it is also possible to alter the angle, at a given position of the inner end of the boom (thus without rotation of the boom) and at a given position of the object suspension device, thus without raising or lowering the object. According to possible embodiments of the present invention the following alternatives to adjust the angle are envisaged:

- altering the relative positions of the departing sheave and the hoist cable retention device,
- providing a hoist cable guide which, at an operational position thereof, is adapted to guide at least one of the second suspension cable parts between the boom and the object suspension device.

In a possible embodiment according to the first and second aspect of the invention, the crane vessel is furthermore provided with a hoist cable guide which, at an operational position thereof, is adapted to guide at least one of the second suspension cable parts between the boom and the object suspension device. In an engaged situation, at least one of the second suspension cable parts extends from the object suspension device via the hoist cable guide to the boom. Thus instead of extending directly to the boom, the cable is guided by the hoist cable guide, which is positioned lower (seen in vertical direction) than the boom. As the at least one of the second suspension cable parts now no longer has to extend to the boom but is allowed to extend to a lower point, in terms of height, the angle between the first and second suspension cable parts will be larger.

The hoist cable guide may be provided releasable, such that only when objects are actually lowered into (deep) water, the hoist cable guide is provided. For example, the hoist cable guide is pivotable between a folded-away position and an active position in which it may guide the hoisting cable.

Preferably, the hoist cable guide is attached to the crane housing, such that when the boom, the hoisting cable and the object suspension device are slewed about the vertical rotation axis, the hoist cable guide is rotated with them. Alternatively, it is also conceivable that the hoist cable guide is attached to the stationary pedestal, or even to the hull of the vessel. As such, rotation is no longer possible but this is not always be required when lowering objects.

According to the first and second aspect of the invention, it is conceivable that multiple hoist cable guides are provided at various positions, e.g. connected to the hull and to the pedestal.

In an embodiment in which a hoist cable guide is provided, the angle between the first and second suspension cable parts is thus adjusted by allowing the hoist cable guide to engage with the second suspension cable part, or vice versa, and subsequently guiding the second suspension cable part and creating a larger angle between the first and second suspension cable parts.

It is conceivable that the hoist cable guide is allowed to engage the second suspension cable part by bringing the second suspension cable part in the vicinity of the hoist cable guide.

In a possible embodiment the crane is operable to move the one or more second suspension cable parts to a position wherein the hoist cable guide is able to engage the one or more second suspension cable parts. The boom may be slewed to a position above the hoist cable guide. Subsequently, the luffing cable may be actuated to allow the boom and thus the radially inward location from which the second suspension cable part is suspended, to move to a position essentially above the hoist cable guide, in which position the hoist cable guide is able to engage with the second suspension cable part. Hence, the luffing device is used to position the boom essentially vertical, bringing the hoist cable retention device, to which the hoisting cable extends, at a position essentially above the hoist cable guide, and as such allow the hoisting cable to engage with the hoist cable guide (or the hoist cable guide to engage with the hoisting cable).

In particular, in the case of a knuckleboom assembly, the hoist cable retention device may possibly be provided at the second pivot axis, and the departing sheave at the jib. Possibly, not only the luffing cable may have to be actuated to bring the hoist cable retention device in a position essentially above the hoist cable guide, but also jib positioning means, for positioning the jib relative to the main boom.

It is noted that to achieve the engagement of the hoisting cable with the hoist cable guide, the position of the object suspension device is not altered but the position of the inner end of the boom will be altered by actuating the luffing cable. However, the position of the inner end of the boom may be brought back to the same position before the engaging operation, and as such, different angles between the hoisting cable portions are possible at a given position of the inner end of the boom and of the object suspension device, by actuating the luffing cable, and possibly also by the jib positioning means.

In an alternative embodiment, it is conceivable that the hoist cable guide is allowed to engage the second suspension cable part by bringing the hoist cable guide into engagement with second suspension cable part.

This can be achieved according to a possible embodiment wherein the hoist cable guide is connected to a guide hoist and a guide tugger, wherein the guide hoist comprises a boom portion extending between the boom and the hoist cable guide, which boom portion extends radially outwards of the suspension cable part which is or is to be engaged by the hoist cable guide, and wherein the guide tugger originates from the operational position of the hoist cable guide, such that by actuating the guide hoist and the guide tugger the hoist cable guide can move between a position adjacent the boom and the operational position of the hoist cable guide wherein the hoist cable guide is adapted to guide a suspension cable part.

As indicated above, the angle between the first and second suspension cable parts may be varied according to the present invention alternatively by altering the relative positions of the departing sheave and the hoist cable retention device, According to an embodiment of the present invention, this can be achieved by providing a knuckleboom assembly. As indicated above, a knuckleboom assembly comprises a main boom and a jib. The hoist cable retention device is preferably provided at the second pivot axis, between the main boom and the jib. The departing sheave is provided on the jib. The distance in the horizontal plane position between the departing sheave and the hoist cable retention device may thus be altered by altering the rotational position of the jib, relative to the main boom. Of course, the absolute distance between departing sheave and second pivot axis will not alter, but the distance as seen in horizontal direction will change, and as a consequence the angle between the first and second hoisting cable portions will vary. In this embodiment, the angle adjusting device thus comprises jib positioning means, for positioning the jib relative to the main boom.

As indicated above, the angle between the first and second suspension cable parts may be varied according to the present invention alternatively by altering the position of the hoist cable retention device with respect to the departing sheave.

According to a possible embodiment according to the second aspect of the invention, the hoist cable retention device is provided on a trolley which is allowed to move along the boom, thereby changing the angle between the first and second suspension cable parts.

The invention can be summarized according to one or more of the following clauses:

1. Crane vessel for offshore lifting and lowering objects, comprising a hull and a crane, the crane comprising:
   - a stationary pedestal mounted to or formed integral with the hull of the vessel;
   - a crane housing that is rotational relative to the pedestal about a vertical rotation axis;
   - a boom assembly comprising an inner end and a tip, the inner end is connected pivotably about a first horizontal pivot axis to the crane housing;

a luffing device in order to position the boom assembly, extending between the boom assembly and the crane housing;

a object suspension device to which the object can be connected;

a multiple fall hoist assembly which comprises a winch and an associated hoisting cable, the hoisting cable extending from the winch, to the tip of the boom assembly, to the load suspension device, such that upon actuation of the winch the object suspension device can be raised and lowered;

characterized in that a hoist cable retention device is provided on the boom assembly at a distance from the tip of the boom assembly, allowing the hoisting cable to extend from the object suspension device to the hoist cable retention device, such that a first portion of the hoisting cable extending from the tip of the boom assembly towards the object suspension device and a second portion of the hoisting cable extending away from the object suspension device towards the hoist cable retention device extend at V-shape with respect to each other, at an angle of preferably between 20 and 60°.

2. Crane vessel according to clause 1, further comprising an angle adjusting device for adjusting the angle between the first and second portion of the hoisting cable at a given position of the inner end of the boom assembly and the load suspension device.

3. Crane vessel according to clause 2, wherein a hoist cable guide can be provided near the pedestal of the crane, preferably attached to the crane housing, and wherein the angle adjusting device allows the hoist cable guide to engage with the second portion of the hoisting cable, such that in the engaged situation the second portion of the hoisting cable extends from the object suspension device via the hoist cable guide to the hoist cable retention device.

4. Crane vessel according to clause 3, wherein the angle adjusting device comprises the luffing device, allowing the boom assembly, and thus the hoist cable retention device to move to a position essentially above the hoist cable guide, such that the second portion of the hoisting cable is adjacent the pedestal, in which position the hoist cable guide is able to engage with the second portion of the hoisting cable.

5. Crane vessel according to clause 3, wherein the hoist cable guide is a wire guide, and wherein the angle adjusting device comprises a wire guide hoist extending from a position near the tip of the boom assembly, and a hoist wire tugger extending from a position near the pedestal of the crane, both extending to the wire guide, such that upon actuation of the angle adjustment device the position of the wire guide can be varied, and the hoisting cable may be allowed to engage the wire guide.

6. Crane vessel according to clause 2, wherein the hoist cable retention device comprises a trolley, and wherein the angle adjusting device allows the trolley to move along the boom assembly.

7. Crane vessel according to one or more of the preceding clauses, wherein the boom assembly is a knuckleboom assembly, comprising:

a main boom comprising the inner end which is connected pivotably about a first horizontal pivot axis to the crane housing; the main boom further comprising a central area and an outer end; and a jib comprising the tip of the boom assembly, and further a central area and an inner end opposite the tip, the inner end of which is connected pivotably about a second horizontal pivot axis to the outer end of the main boom;

wherein the jib is pivotable at least between an extended position in which the tip extends mainly forward from the main boom, and a folded position in which the jib is folded back along the main boom;

wherein the hoist cable retention device is provided at the second pivot axis.

8. Crane vessel according to one or more of the preceding clauses, wherein the pedestal is embodied as a fixed mast, and wherein crane housing is embodied as a rotating slew platform supporting the boom assembly and a rotatable mast head at the top of the mast.

9. Crane vessel according to one or more of the preceding clauses, wherein the hoisting cable has a dead end, and wherein a hoist cable retention device is embodied as a dead end connection point provided at the boom assembly.

10. Crane vessel according to one or more of the preceding clauses, wherein the multiple fall hoist assembly is a double fall hoist assembly.

The invention is further explained in relation to the attached drawings, in which.

Figure 12A:
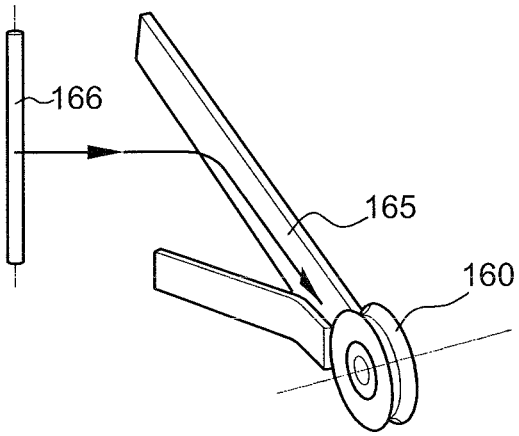
Figure 12B:
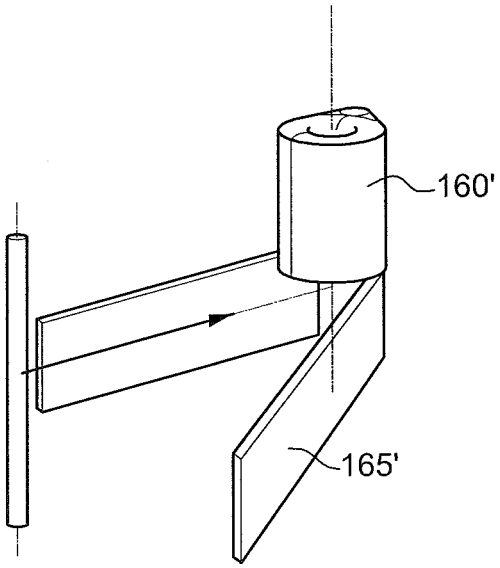
Figure 13:
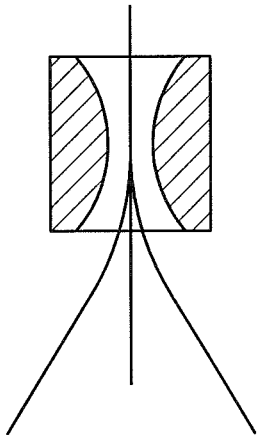

FIGS. 10*a*-10*e* schematically depict a pedestal, hoist cable guide and hoist cable receiver according to an embodiment of the first and second aspect of the present invention;

FIGS. 11*a*-11*d* schematically depict alternative methods of bringing a suspension cable part into engagement with a hoist cable guide according to the first and second aspect of the present invention;

FIGS. 12*a* and 12*b* schematically depict yet alternative methods of bringing a suspension cable part into engagement with a hoist cable guide according to the first and second aspect of the present invention;

FIG. 13 schematically depicts an embodiment of a hoist cable guide according to the first and second aspect of the present invention.

In FIGS. 1A-1H a crane vessel 1 is visible according to the first and second aspect of the invention, comprising a hull 2 and a deck 3. On deck 3 an object 10 is placed, which is to be lifted from deck 3 and subsequently lowered into the water, generally indicated with the letter W.

A stationary pedestal 5 is mounted integral with the hull 2 of the vessel, and extends above deck 3. A crane housing 6 is mounted rotational relative to the pedestal 5, about a vertical rotation axis R1.

A boom 11 is connected pivotably to the crane housing 6. In the shown embodiment, the boom 11 is a knuckleboom assembly, comprising a main boom 12 comprising an inner end, which is connected pivotably about the pivot axis R2 to the crane housing 6. The knuckleboom assembly further comprises a jib 13 comprising a tip T of the boom 11. The outer end of the main boom 12, opposite the inner end, is connected pivotably about a second horizontal pivot axis R3 to an inner end of the jib 13, opposite the tip T. The jib 13 is pivotable at least between an extended position in which the tip T extends mainly forward from the main boom 12, as visible in FIGS. 1A-1D and a folded position in which the jib is folded back along the main boom, as visible in FIG. 1F.

In order to position the main boom 12 of the knuckleboom assembly, a luffing device 14, here a luffing cable 14, is provided, extending between the second pivot axis R3 of the knuckleboom assembly 11 and the crane housing 6, in particular an upright portion of the crane housing 6.

In order to position the jib 13 with respect to the main boom 12, in the shown embodiment, a tensioning member 15 and a curved extension guide 16 are provided, the tensioning member 15 extending between the crane housing 6, here a central portion of the upstanding portion of the crane housing, and the curved extension guide 16. The curved extension guide 16 is connected to the jib 13 and is pivotable together with the jib about the second pivot axis R3. The curved extension guide 16 guides a portion of the tensioning member 15, wherein a second winch allows to vary the length of the tensioning member and thus to position the jib.

A double fall hoist assembly is provided, comprising a winch 16 provided in the hull 2 of the vessel. From the winch 16, a hoisting cable 17 extends through the pedestal 5, the crane housing 6, via a sheave S1 and sheave S2 at the second horizontal pivot axis R3 to the tip T of the boom, where the cable 17 is guided by a departing sheave S3 (FIGS. 1A-1E, 1G, 1H) or departing sheave S4 (FIG. 1F), to an object suspension device 18.

In the shown embodiment, the object suspension device 18 is a hook, capable of engaging object 10, comprising a sheave S5 for guiding the hoisting cable 17. The hoisting cable 17 comprises a first suspension cable part 17*a* extending between the object suspension device 18 and the departing sheaves S3, S4 at a radially outward location of the boom, here tip T.

According to the present invention, a hoist cable retention device H is provided on the boom 11, here provided at a radially inward location relative to the radially outwardly provided departing sheave S3, S4. The hoisting cable 17 thus comprises a second suspension cable part 17*b* extending between the objection suspension device 18 and cable retention device H, such that the first and second suspension cable parts 17*a*, 17*b* extend at V-shape with respect to each other, at an angle of preferably between 20 and 60°. Here, the hoisting cable 17 has a dead end, connected to the hoist cable retention device H, at the second horizontal pivot axis R2.

Figure 1A:
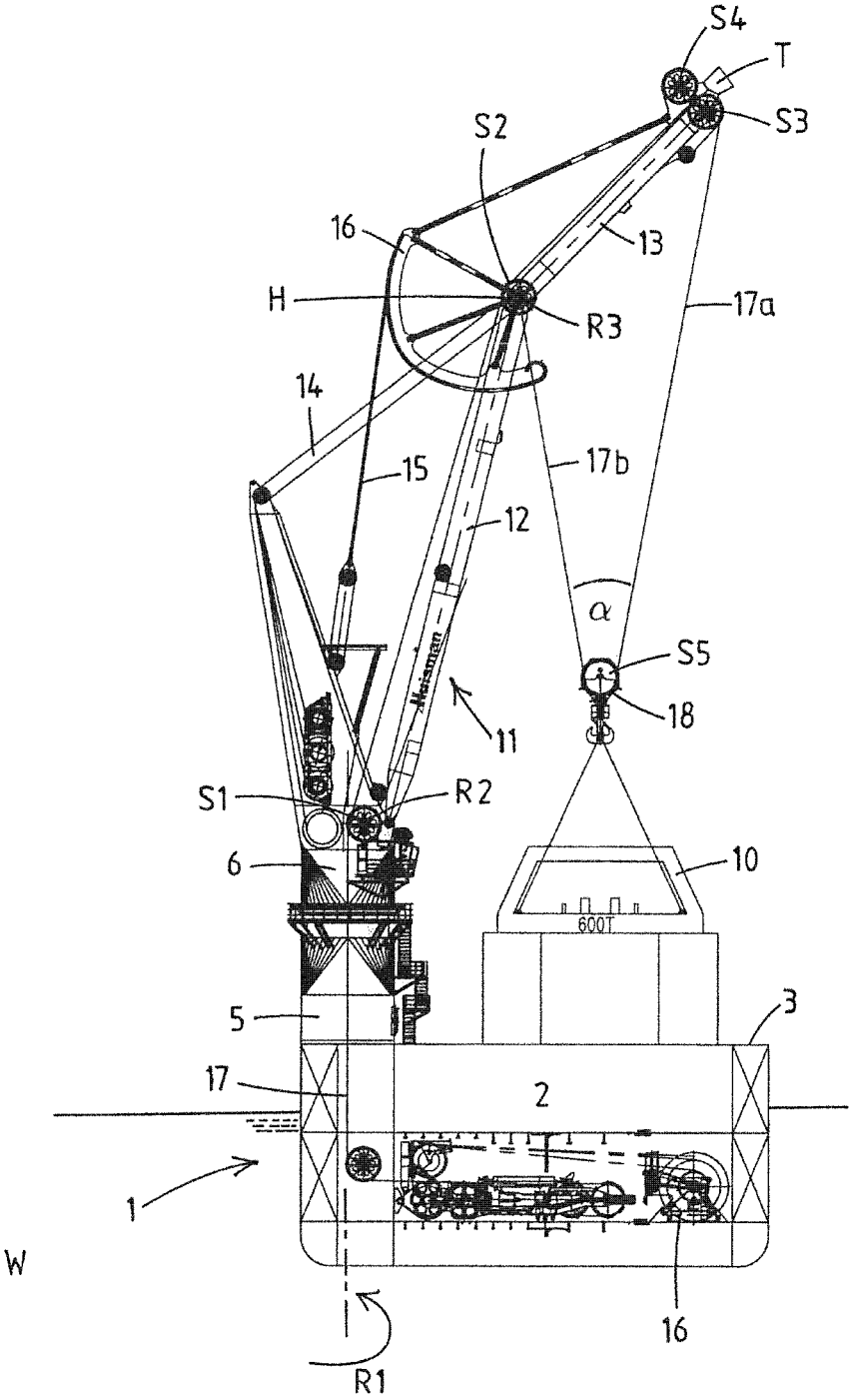
FIGS. 1A-1H show various load hoisting and lowering steps using a first embodiment of a crane vessel according to the first and second aspect of the present invention.
Figure 1B:
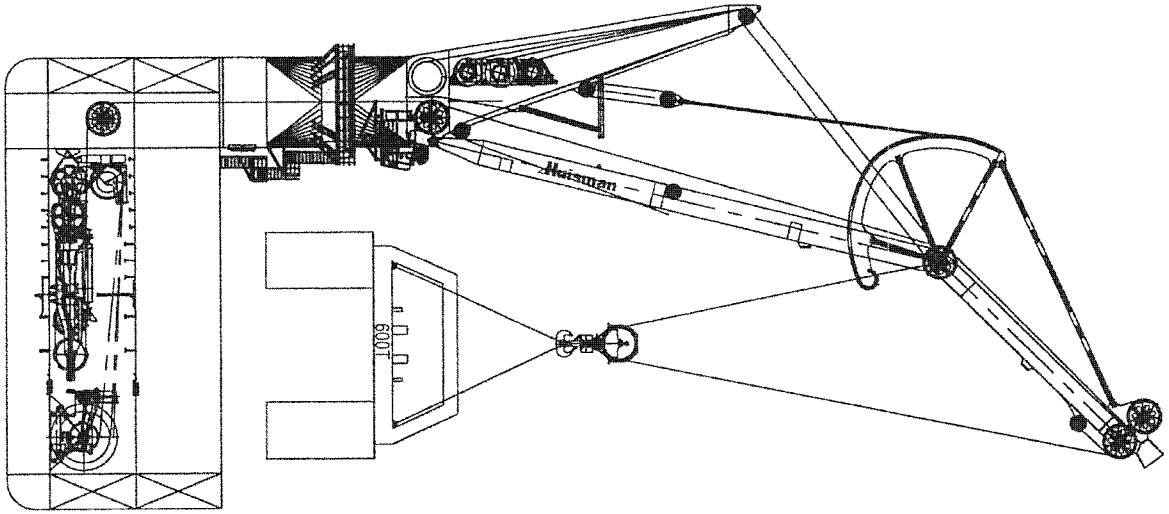
Figure 1C:
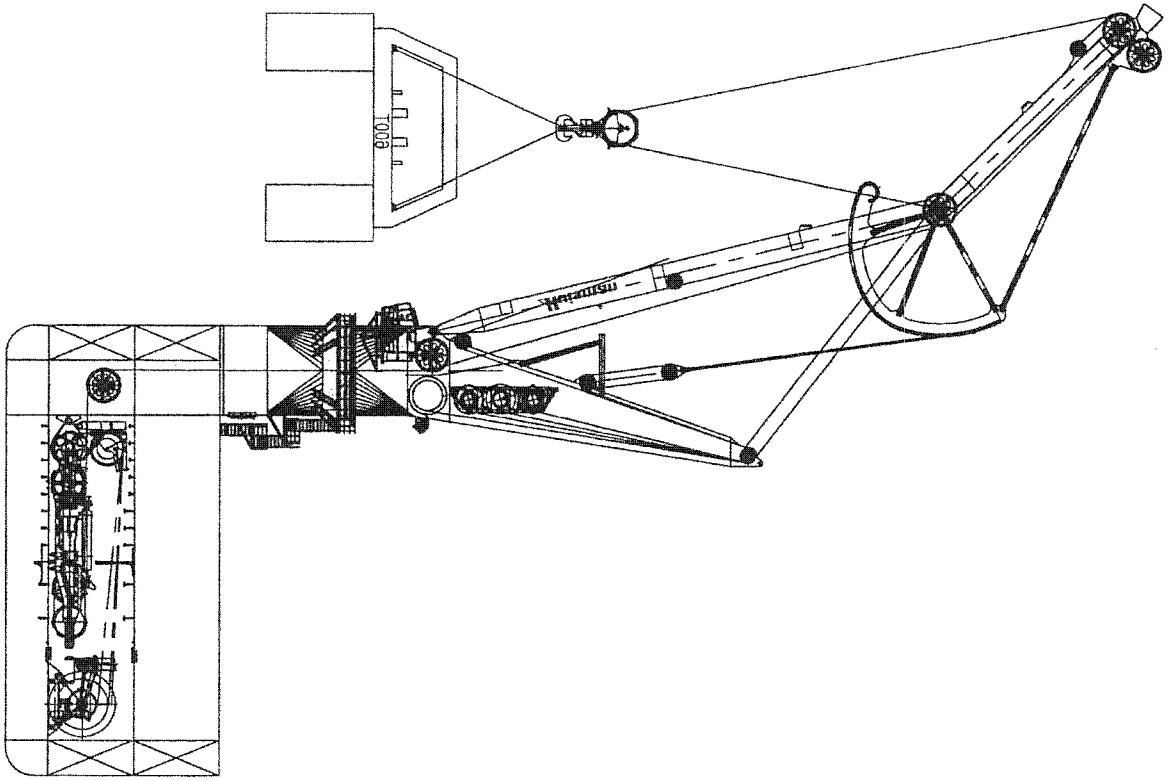

As visible in FIG. 1B, upon actuation of hoist winch 16, the object 10 can be lifted in an unchanged configuration of the crane housing and boom. In FIG. 1C, the crane housing 6 has rotated about rotation axis R1, to bring the object 10 above the water W, in which the hoisting cable may be paid out even further to lower the object, as visible in FIG. 1D.

Figure 1D:
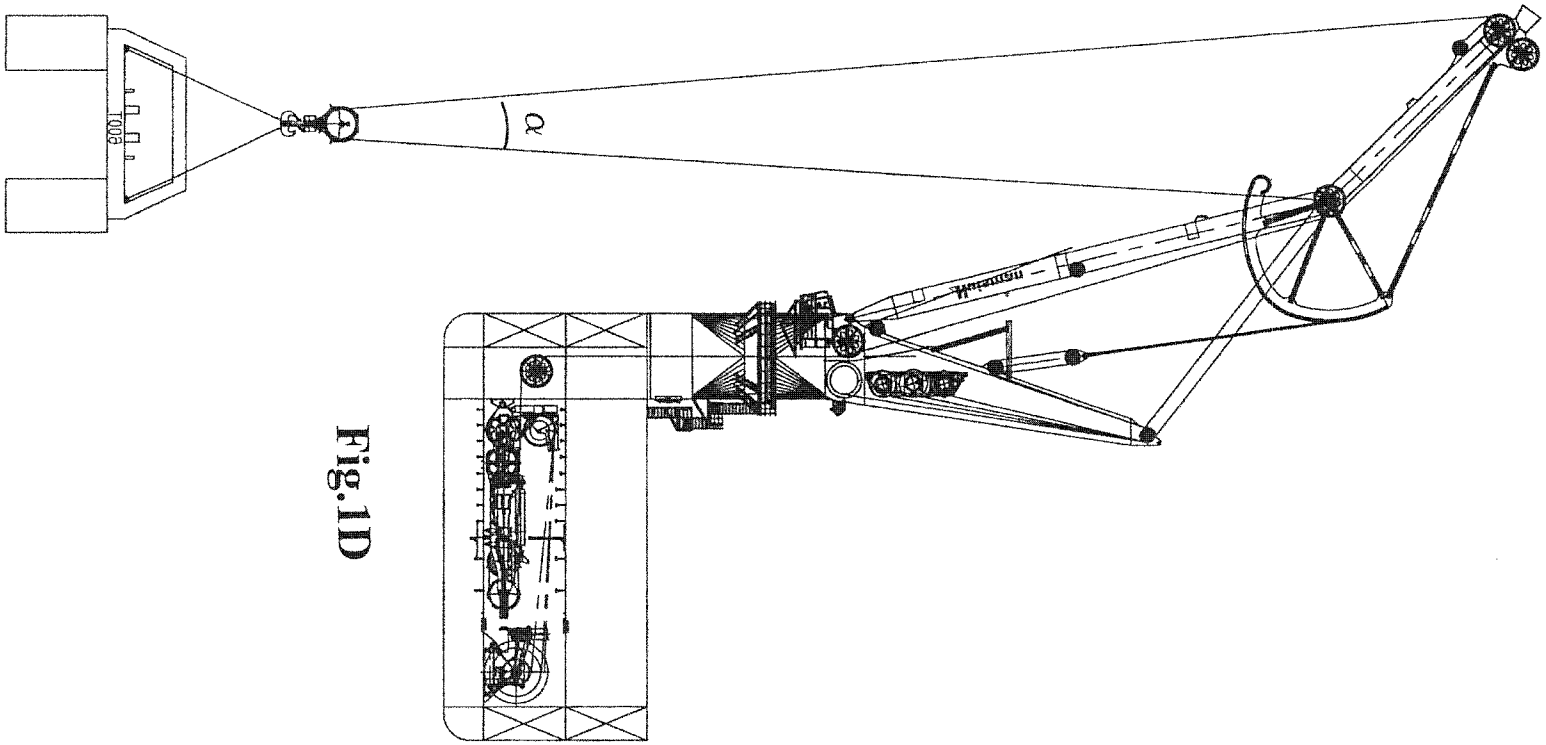
Figure 1E:
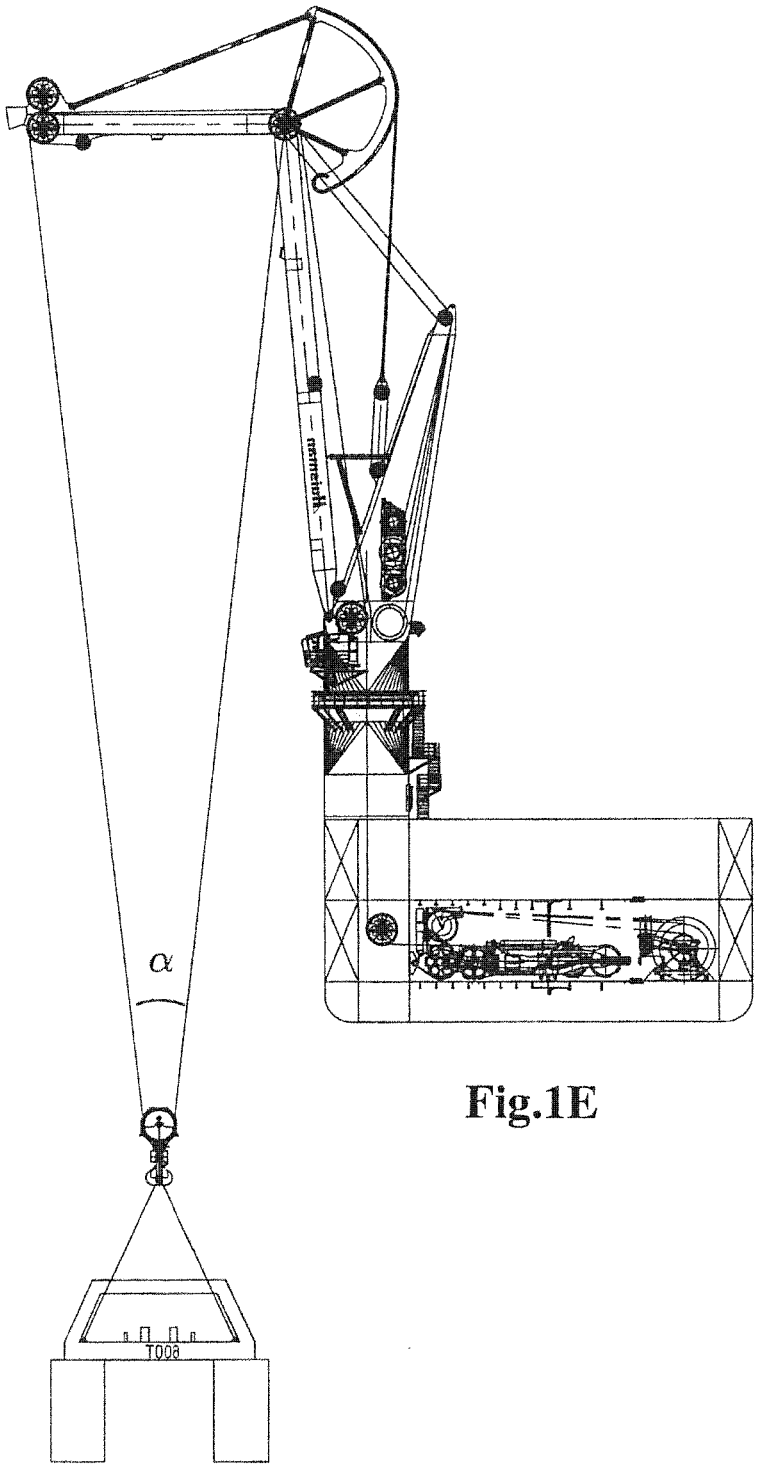

In FIG. 1E it is visible that the angle α has increased with respect to the position shown in FIG. 1D, without changing the position of the inner end of the boom (thus without rotating the main boom 12) and without altering the position of the object suspension device 18. This is achieved by actuating the tensioning member 15, and thus altering the position of the jib 13 relative to the main boom 12. This thus visualizes an embodiment of the invention, according to which the angle between the first and second suspension cable parts is adjusted by positioning the jig.

Figure 1F:
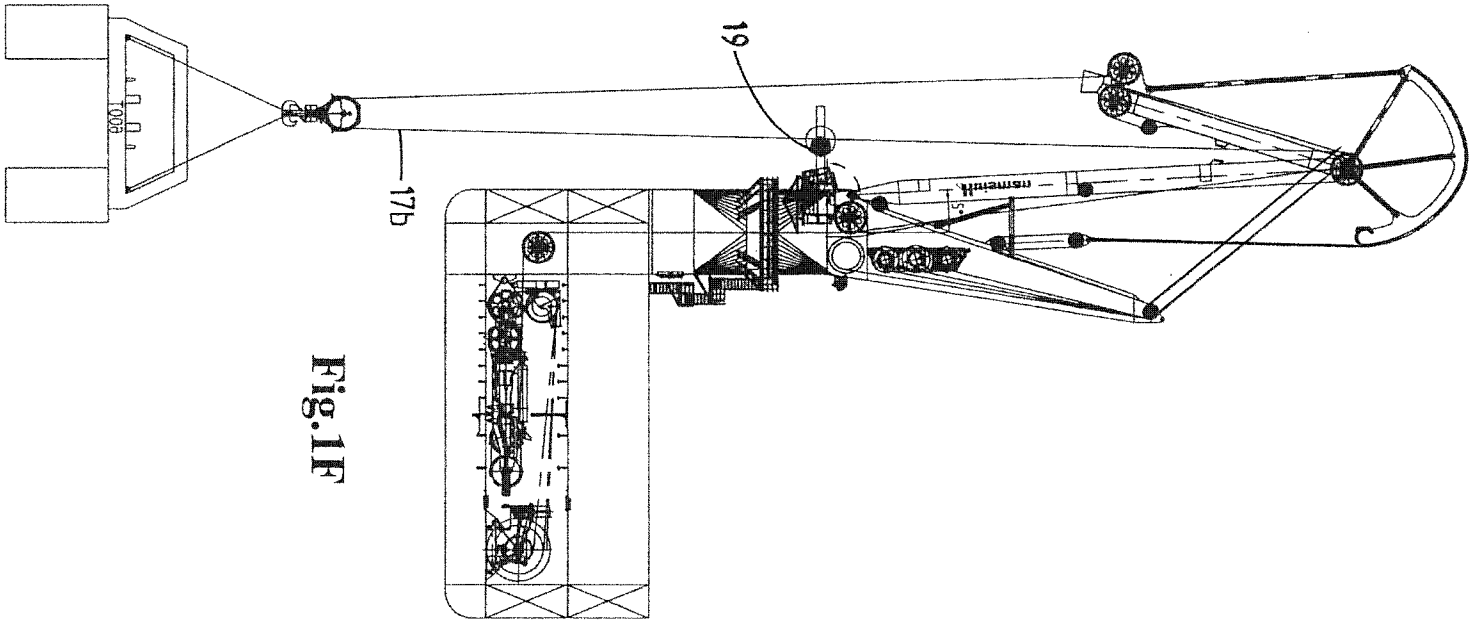

In FIG. 1F, angle α has decreased to a minimum, but it is now visible that the combined operations of jib positioning means, i.e. tensioning member 15, and luffing device 14, have brought the hoist cable retention device H to a position essentially above a hoist cable guide 19, which has now been brought into its active position. In FIGS. 1A-1E, the hoist cable guide is not visible. By bringing the hoist cable retention device H above this hoist cable guide 19, the second portion 17*b* of the hoisting cable is allowed to engage with the hoist cable guide 19, such that in the engaged situation the second portion of the hoisting cable 17B extends from the object suspension device 18 via the hoist cable guide 19 to the hoist cable retention device H.

As such, an alternative embodiment of the invention is visualized, according to which an additional hoist cable guide is provided, and wherein the combined operations of jib positioning means, i.e. tensioning member 15, and luffing device 14 allow the hoist cable guide to engage with the second portion of the hoisting cable 17*b*.

Figure 1G:
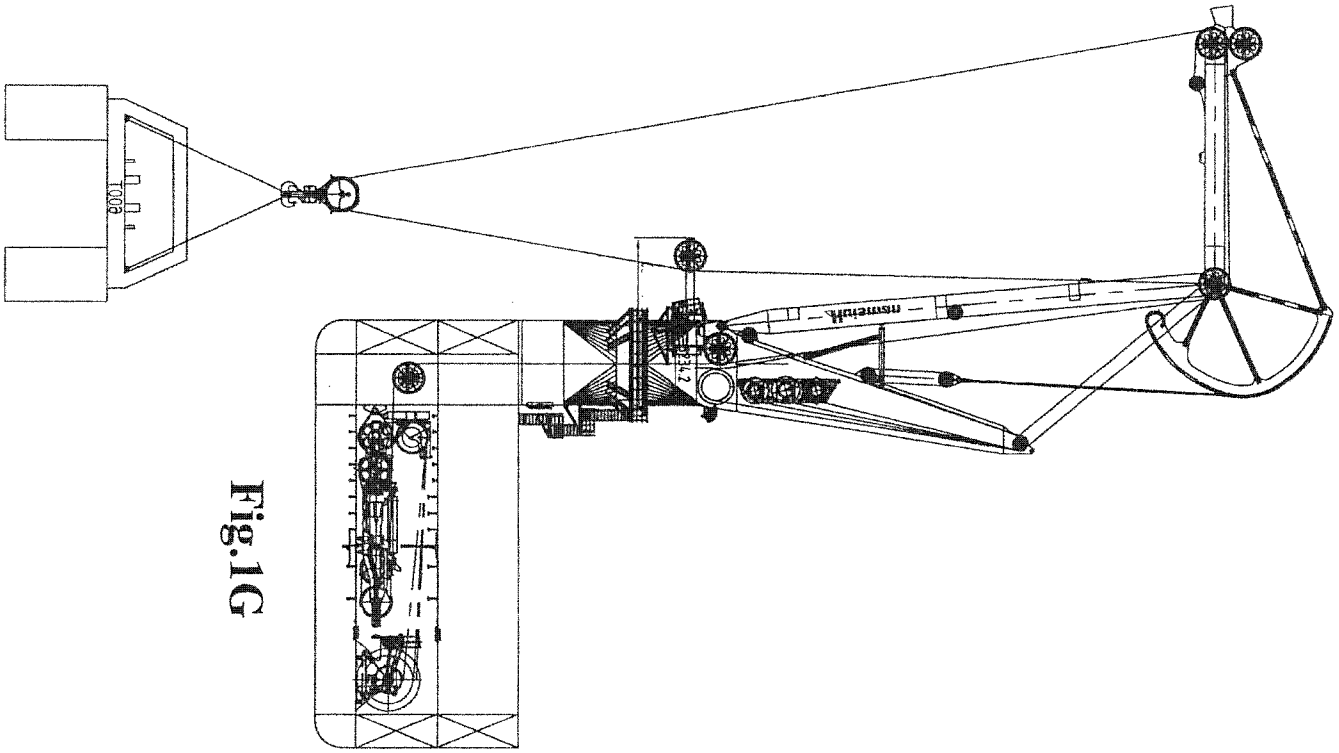

By comparing FIGS. 1E and 1G, it is visible that the angle α is enlarged at a given position of the inner end of the boom and of the load suspension device. To achieve this enlargement, is noted that the position of the knuckleboom assembly is altered by actuating the luffing cable and the jib positioning means.

Figure 1H:
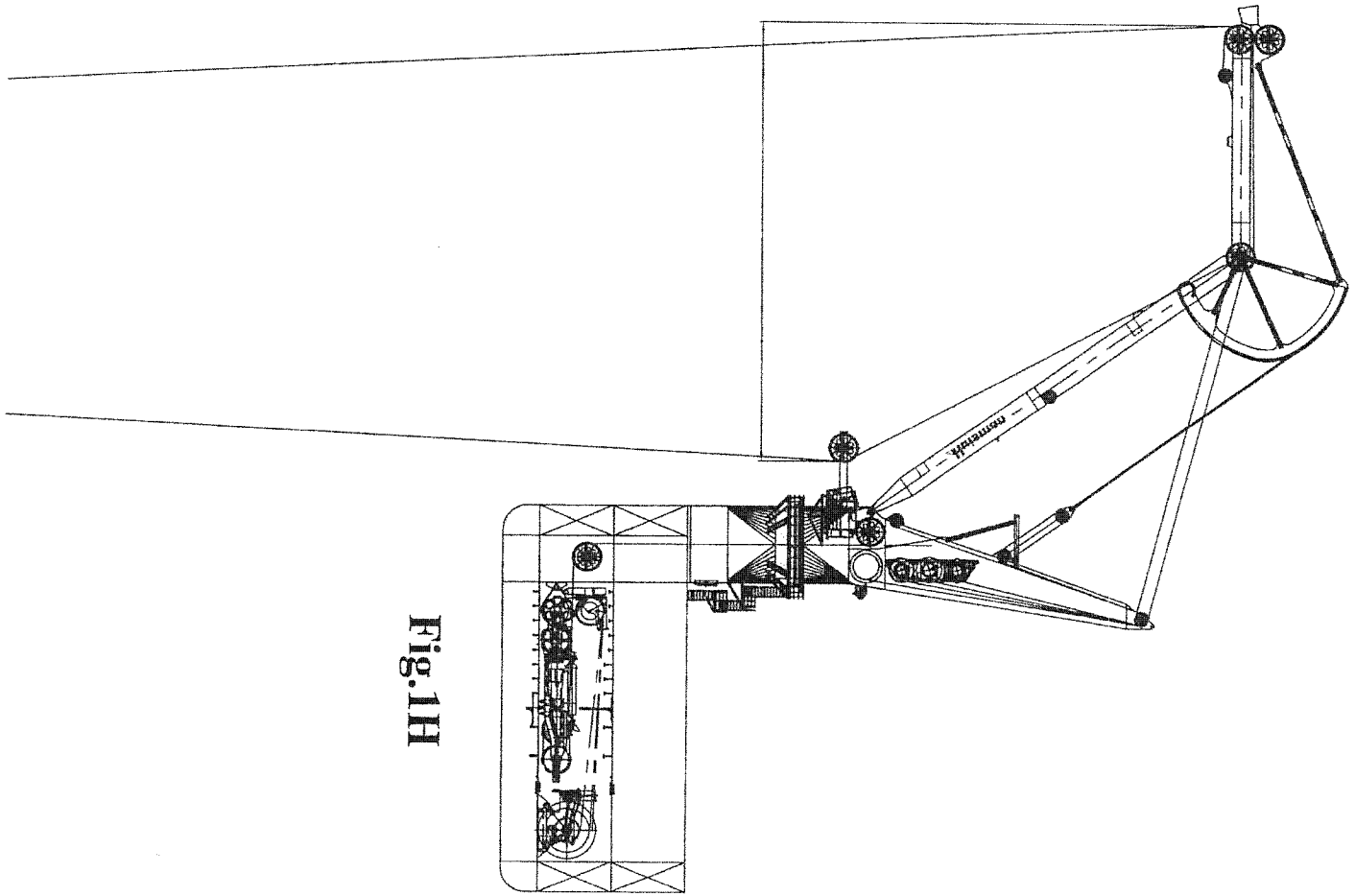

Subsequently, as visible in FIGS. 1G and 1H, the boom 11 may be brought in any desired position, enlarging angle α as much as possible to prevent entanglement (wire twisting).

Figure 2A:
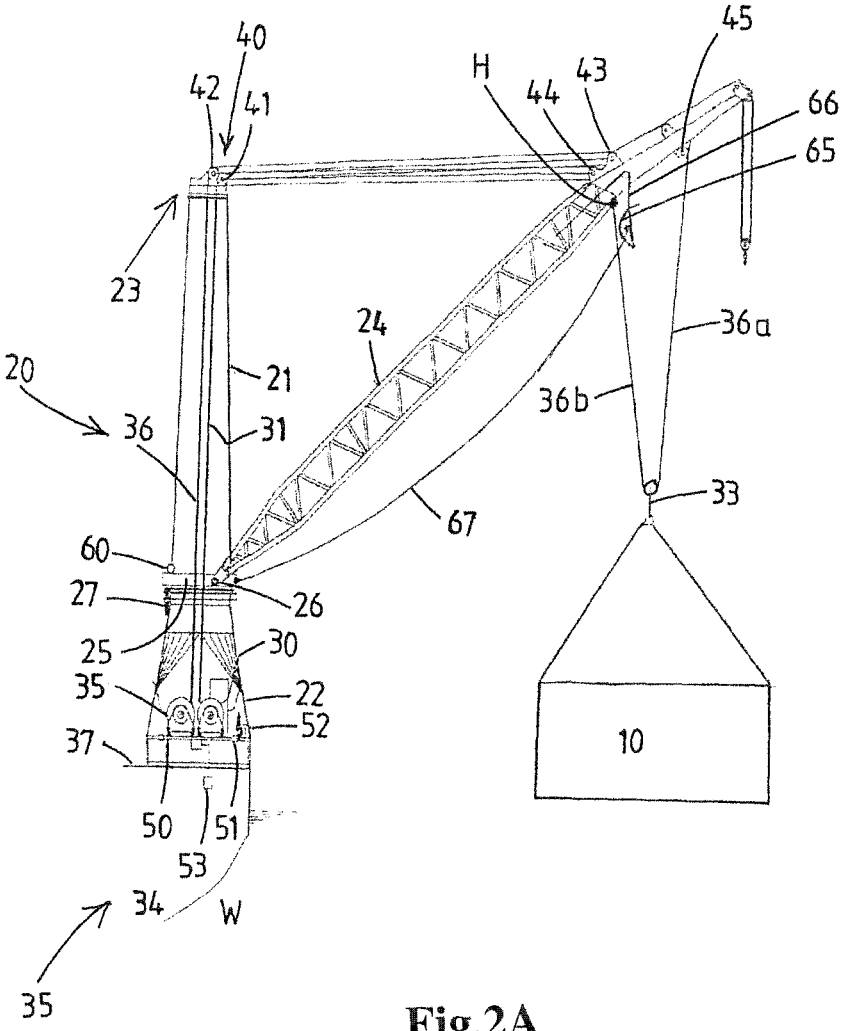
FIGS. 2A and 2B show load hoisting and lowering steps using a second embodiment of a crane vessel according to the first and second aspect of the present invention.
Figure 2B:
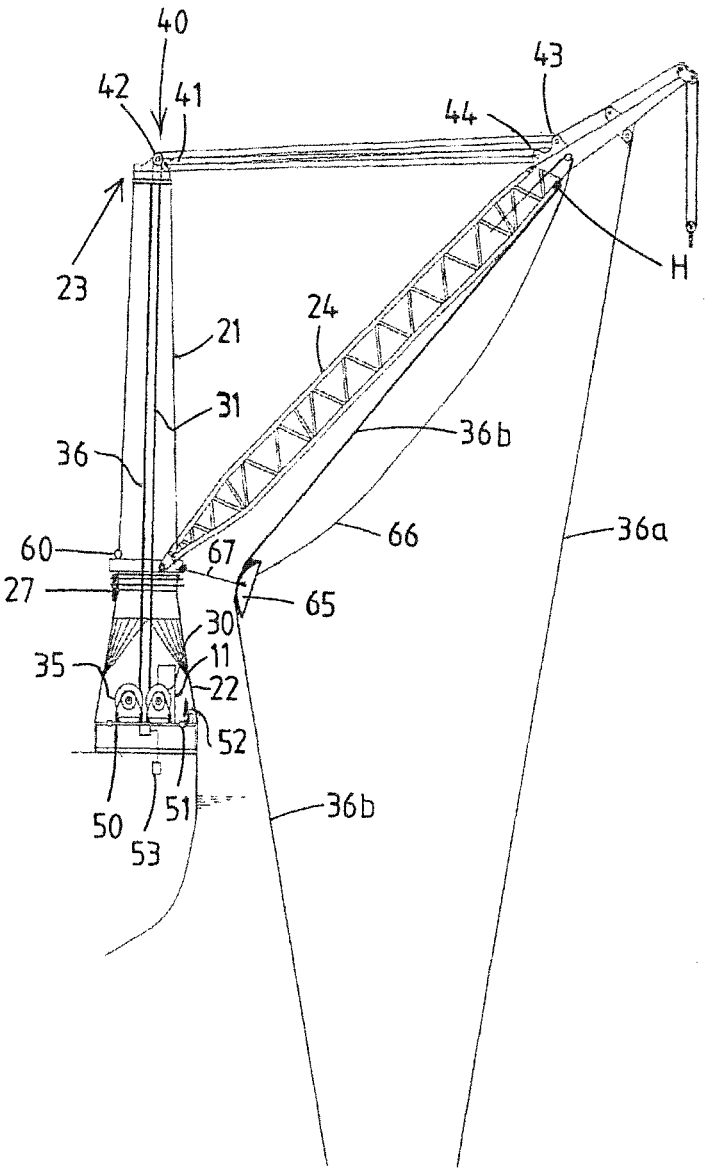

In FIGS. 2A and 2B a second embodiment of a crane vessel 35 according to the first and second aspect of the present invention is shown. Only a small portion of the hull 34 and a deck 37 are visible.

A hoisting crane 20 has a substantially hollow vertical column 21 with a foot 22, which in this case fixed to deck 37 of the vessel 35. This combination forms the stationary pedestal of the crane. Furthermore, the column 21 has a top 23 and an annular bearing structure 25 extending around the vertical column 21, both are rotatably mounted to the vertical column and form the rotatable crane housing.

The hoisting crane 20 has a boom 24. The annular bearing structure 25 guides and carries a boom connection member 26, so that the boom connection member 26, and therefore the boom 24, can rotate about the column 21.

The boom connection member 26 forms a substantially horizontal pivot axis, so that the boom 24 can also be pivoted up and down. There is at least one drive motor 27 for displacing the boom connection member 26 along the annular bearing structure 25. By way of example, the annular bearing structure 25 comprises one or more guide tracks which extend around the column 21 and on which an annular component of the boom connection member 26 is supported via running wheels. The drive motor 27 may, for example, drive a pinion which engages with a toothed track around the column 21.

To pivot the boom 24 up and down, a luffing device is provided. In this embodiment, the luffing device comprises a winch 30 provided with a luffing cable 31 which engages on the boom 24.

Furthermore, the hoisting crane 20 comprises a double fall hoist assembly which comprises a hoisting winch 35 for raising and lowering a load 10, with an associated hoisting cable 36 and a load suspension device, here a hoisting hook 33.

At the top 23 of the column 21 there is a top cable guide 40 provided with a cable pulley assembly 41 for the luffing cable 31, and with a cable pulley assembly 42 for the hoisting cable 36.

One or more cable pulley assemblies 43 for the hoisting cable 36 and a cable pulley assembly 44 for the luffing cable 31 are arranged on the boom 24.

Hoisting cable 36 thus extends from the winch 35 to a departing sheave 45 of the boom 24 to the object suspension device 33. It is noted that in this embodiment, also within the scope of the invention, the hoisting cable does not extend to the ultimate tip of the boom, but to a departing sheave 45 provided near the tip of the boom.

The winches 30 and 35 are in this case disposed in the foot 22 of the vertical column 21, so that the topping cable 31 and the hoisting cable 36 extend from the associated winch 30, 35 upward, through the hollow vertical column 21 to the top cable guide 40 and then towards the cable guides 43, 44 on the boom 24.

The top cable guide 40 has a rotary bearing structure, for example with one or more running tracks around the top of the column 21 and running wheels, engaging on the running tracks, of a structural part on which the cable pulley assemblies are mounted. As a result, the top cable guide 40 can follow rotary movements of the boom about the vertical column 21 and adopt substantially the same angular position as the boom 24.

The top cable guide 40 may have an associated drive motor assembly which ensures that the top cable guide 40 follows the rotary movements of the boom 24 about the column 21, but an embodiment without drive motor assembly is preferred.

The boom winch 31 and the hoisting winch 35 are arranged on a rotatable winch support 50, which is rotatable about a rotation axis substantially parallel with the vertical column 21. The movable winch support 50, which is mounted movably with respect to the vertical column 21. The winch support 50 here is located in the vertical crane structure, preferably in the region of the foot 22 under the circular cross section part of the column 21, and is mechanically decoupled from the top cable guide 40. The support 50 could e.g. also be arranged in the hull of the vessel below the column, e.g. the foot could have an extension which extends into the hull.

In the example shown, the winch support 50 is a substantially circular platform which at its circumference is mounted in an annular bearing 51, with the winches 31, 35 arranged on the platform. The annular bearing 51 is in this case such that the platform can rotate about a vertical axis which coincides with the axis of rotation of the top cable guide. The bearing can have any appropriate design including trolleys running along a circular track.

The rotatable winch support 50 has an associated drive motor assembly 52 for moving the winch support 50, in such a manner that the winch support 50 maintains a substantially constant orientation with respect to the boom 24 in the event of rotary movements of the boom 24 about the vertical column 21. The orientation of the winch support 50 with respect to the top table guide 40 likewise remains substantially constant, since its movements are once again the consequence of rotary movements of the boom 24.

Possibly, an additional deep water winch (not shown) is positioned below the movable winch support 50.

In the embodiment shown, there is an angle sensor 60 for detecting the position of the boom connection member 26 with respect to the vertical column 21, the drive motor assembly 52 of the winch support 50 having associated control means 53 which are in operative contact with the angle sensor 60.

The winches 31, 35 each have an associated electrical (or electro-hydraulic) winch drive motor assembly which is disposed on the movable winch support 50. The electrical energy required is supplied by generators disposed elsewhere on the vessel, at a distance from the movable winch support 50. One or more sliding contacts (not shown) are provided in the electrical connection between these generators and the winch drive motor assemblies.

In a variant which is not shown, the winch support 50 can rotate about a vertical shaft, this shaft being provided with one or more sliding contacts. In such an embodiment, the deep water cable extends through the center of such shaft.

According to the second aspect of the present invention, a hoist cable retention device H is provided on the boom 24, at a radially inward location relative to the radially outward departing sheave 45, such that a first suspension cable part 36*a* of the hoisting cable extends from the departing sheave of the boom 24 towards the object suspension device 33 and a second suspension cable part 36*b* of the hoisting cable extends away from the object suspension device 33 towards the hoist cable retention device H, wherein the first and second suspension cable parts 36*a*, 36*b* extend at V-shape with respect to each other, at an angle of preferably between 20 and 60°. This is visible in FIG. 2A.

According to a preferred embodiment of the second aspect of the invention, the angle between the first 36*a* and second portion 36*b* of the hoisting cable at a given position of the inner end of the boom 24 and the object suspension device 33 can be adjusted.

To this end, a hoist cable guide 65 is provided, capable of engaging with the second portion 36*b* of the hoisting cable. The hoist cable guide 65 is connected to a guide hoist 66 and a guide tugger 67, wherein the guide hoist comprises a boom portion extending between the boom 24 and the hoist cable guide 65, which boom portion 66 extends radially outwards of the second suspension cable part 36*b* to be engaged by the hoist cable guide 65, and wherein the guide tugger 67 originates from the operational position of the hoist cable guide, here from a position near the pedestal of the crane, in particular from the annular bearing structure. By actuating the guide hoist 66 and the guide tugger 67 the hoist cable guide 65 can move between a position adjacent the fib 24, as visible in FIG. 2*a*, and the operational position of the hoist cable guide 65, as visible in FIG. 2*b*. In the shown embodiment, both guide hoist 66 and the guide tugger 67 are embodied as hoisting cables, which can be operated by winches (not shown).

In FIG. 2A, the guide hoist has been actuated to bring the hoist cable guide 65 close to the tip of the boom. In particular, the guide hoist has been hauled in, while the guide tugger 67 has been allowed to become slack, hardly without any tension being applied to it.

In FIG. 2B, the guide tugger 67 has been hauled in, while the tension on the guide hoist 66 is essentially removed. As such, the engaged situation is achieved, as shown, in which the second portion 36*b* of the hoisting cable extends from the object suspension device 33 (not visible in this figure), via the hoist cable guide 65, which is close to the pedestal of the crane, to the hoist cable retention device H.

Figure 3A:
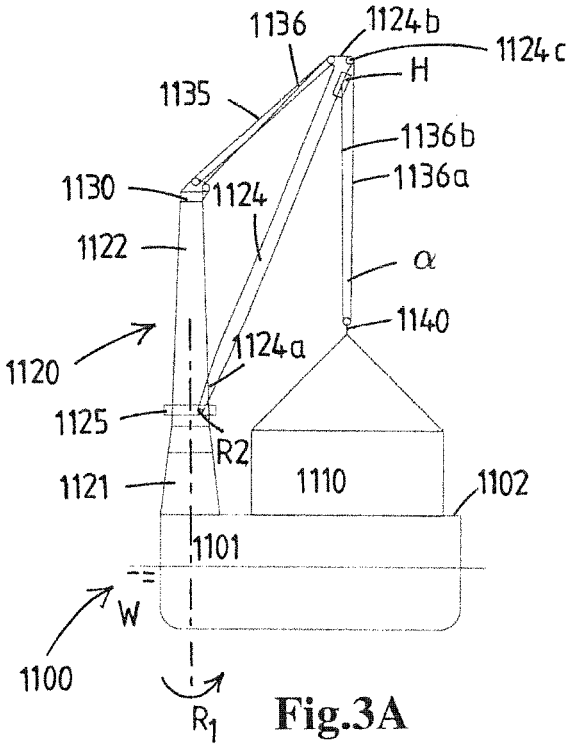
FIGS. 3A-3C show load hoisting and lowering steps using a third embodiment of a crane vessel according to the second aspect of the present invention.
Figure 3B:
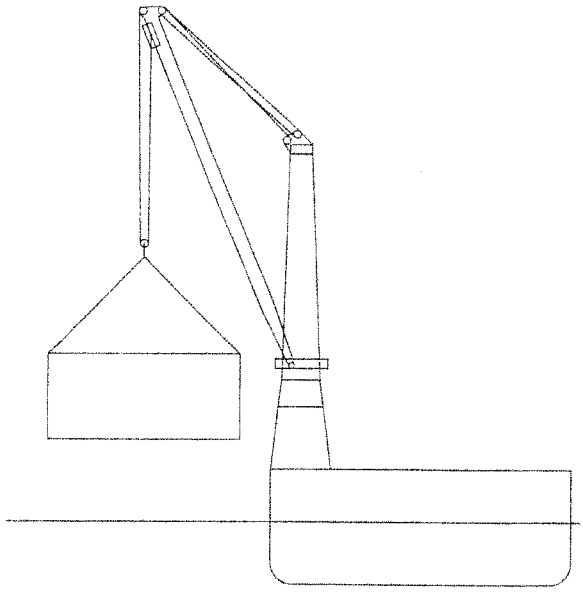
Figure 3C:
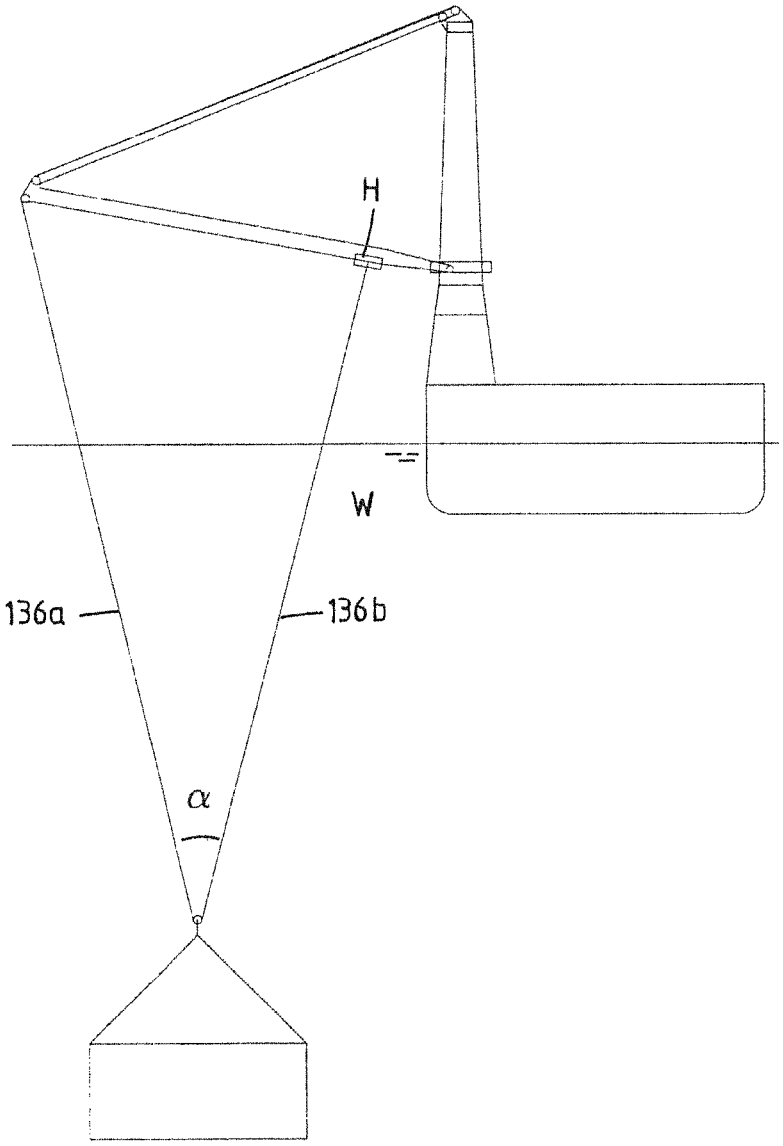

In FIGS. 3A-3C a third embodiment of a crane vessel 1100 according to the present invention is shown. The crane vessel 1100 comprises a hull 1101 and a deck 1102. In FIG. 3*a*, an object 1110 is positioned on deck 1102, which object is to be lifted from deck 1102 and lowered into the water W, as visible in FIG. 3C. Object 1110 is connected to an object suspension device 1140.

On deck 1102 furthermore a crane 1120 is provided, comprising a foot 1121 mounted to the deck and a stationary column 1122 mounted to the foot. A rotary bearing 1125 and a rotary top 1130 together form a crane housing that is rotational relative to the pedestal about a vertical rotation axis R1.

A boom 1124 is provided, the boom 1124 having an inner end 1124*a* which is connected pivotably about a first horizontal pivot axis R2 to the rotary bearing 1125. The boom 1124 further has a tip 1124*b*, where a departing sheave 1124*c* is provided.

A luffing device is provided to position the boom 1124, in the shown embodiment comprising a luffing cable 1135 extending between the boom 1124, here the tip 1124*b* of the boom and the crane housing, here the rotary top 1130.

The crane 1120 further comprises a multiple fall hoist assembly which comprises a winch (not visible) and a hoisting cable 1136. According to the present invention, a hoist cable retention device H is provided on the boom 1124 at a distance from the departing sheave 1124*c* on the boom, allowing the hoisting cable 1136 to extend from the winch, via the rotary top 1130, to the departing sheave 1124*c* on the boom, to the object suspension device 1140 and then to the hoist cable retention device H. As such, a first portion 1136*a* of the hoisting cable extending from the departing sheave 1124*c* of the boom towards the object suspension device 1140 and a second portion 1136*b* of the hoisting cable extending away from the object suspension device towards the hoisting cable retention device H extend at a V-shape with respect to each other, at an angle α which in FIGS. 3*a* and 3*b* is very small.

According to a preferred embodiment, the angle α between the first 1136*a* and second portion 1136*b* of the hoisting cable, at a given position of the inner end of the boom 1124 and the object suspension device 1140, can be enlarged, as is visible in FIG. 3*c*.

In the shown embodiment, this adjustment of the angle α is achieved because the hoist cable retention device H comprises a trolley, which is allowed to move along the boom 1124. For example, a motor device is provided at the trolley, or a winch and cable extend to the trolley, or any conceivable alternative.

Figure 4A:
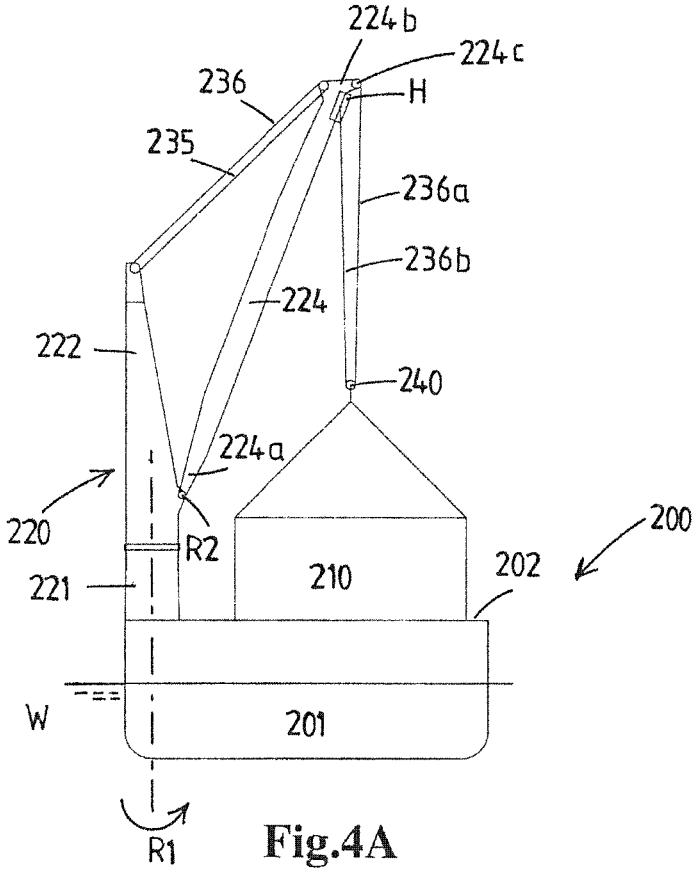
FIGS. 4A-4C show load hoisting and lowering steps using a fourth embodiment of a crane vessel according to the second aspect of the present invention.
Figure 4B:
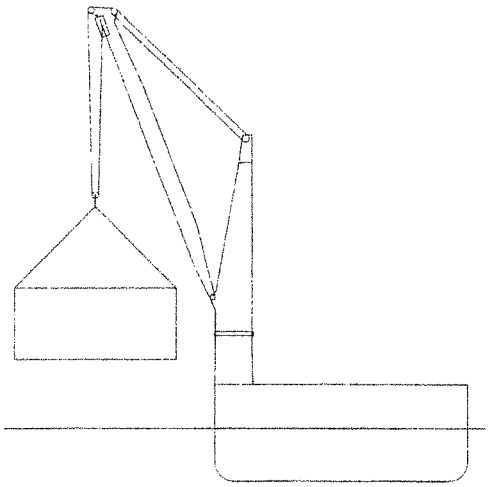
Figure 4C:
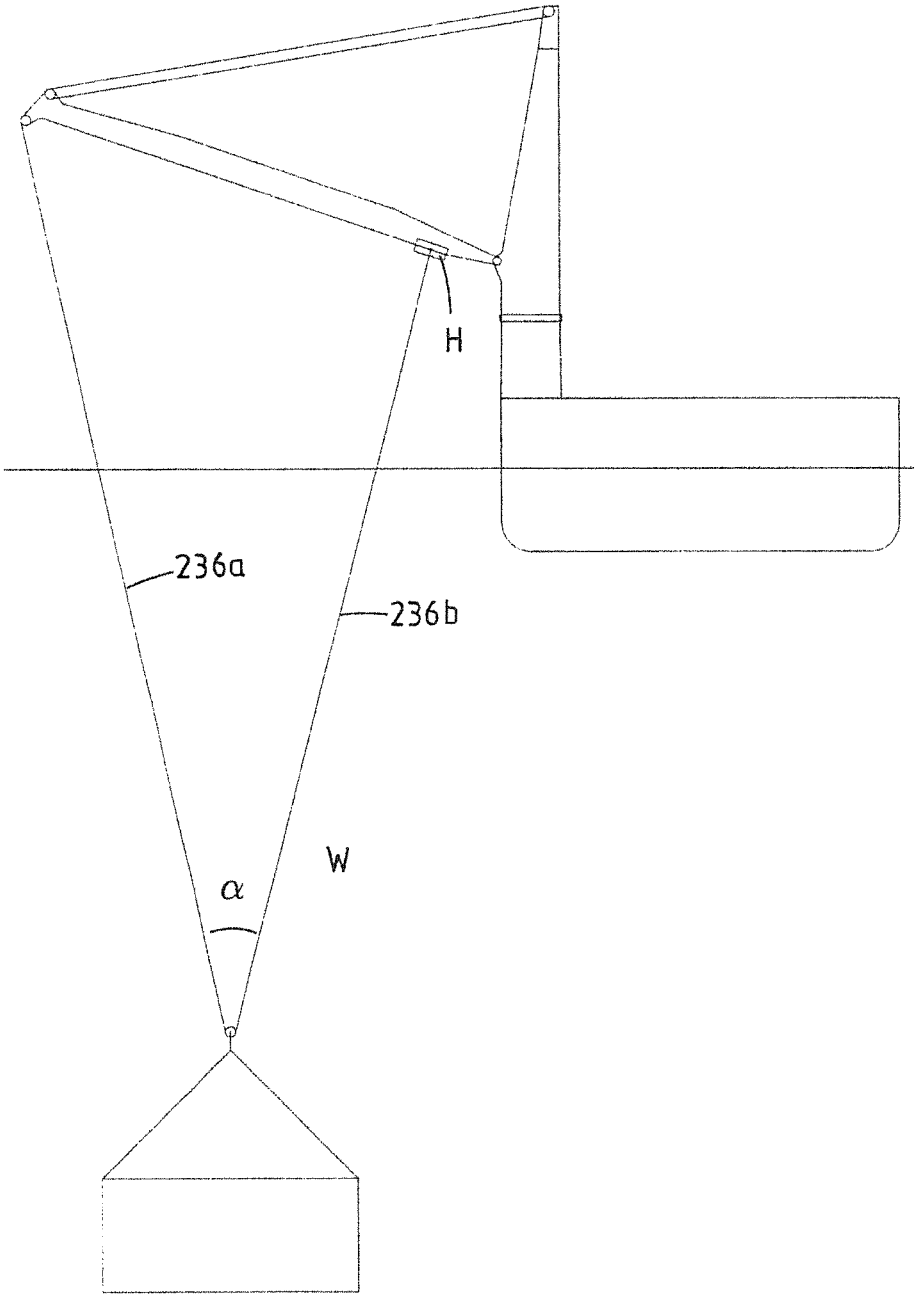

In FIGS. 4A-4C load hoisting and lowering steps using a fourth embodiment of a crane vessel 200 according to the present invention are show. The embodiment highly resembles the embodiment of FIGS. 3A-3C, wherein a trolley is provided as a hoist cable retention device, but differs in that a different crane configuration is employed.

Crane vessel 200 comprises a hull 201 and a deck 202. Object 210 is connected to an object suspension device 240.

On deck 202 a crane 220 is provided, comprising a pedestal 221 mounted to the deck and a crane housing 222 that is rotational relative to the pedestal 221 about a vertical rotation axis R1.

A boom 224 is provided, the boom 224 having an inner end 224*a* which is connected pivotably about a first horizontal pivot axis R2 to the crane housing 222. The boom 224 further has a tip 224*b* where departing sheave 224*c* is provided.

A luffing device is provided to position the boom 224, in the shown embodiment comprising a luffing cable 235 extending between the boom 224, here the tip 224*b* of the boom and the crane housing 222, here the top of the crane housing 222.

The crane 220 further comprises a multiple fall hoist assembly which comprises a winch (not visible) and a hoisting cable 236. According to the second aspect of the present invention, a hoist cable retention device H is provided radially inward on the boom 224, at a distance from the radially outward departing sheave 224*c* of the boom, allowing the hoisting cable 236 to extend from the winch, via the top of the crane housing 222, to the departing sheave 224*c* of the boom, to the object suspension device 240 and then to the hoist cable retention device H. As such, a first suspension cable part 236*a* of the hoisting cable extending from the departing sheave 224*c* of the boom towards the object suspension device and a second suspension cable part 236*b* of the hoisting cable extending away from the object suspension device towards the hoisting cable retention device H extend at a V-shape with respect to each other, at an angle α which in FIGS. 4*a* and 4*b* is very small.

According to a preferred embodiment of the second aspect of the invention, the angle α between the first 236*a* and second suspension cable part 236*b*, at a given position of the inner end of the boom 224 and the object suspension device 240, can be enlarged, as is visible in FIG. 4*c*.

In the shown embodiment, this adjustment of the angle α is achieved because the hoist cable retention device H comprises a trolley, and wherein the trolley is movable along the boom 224.

Figure 5:
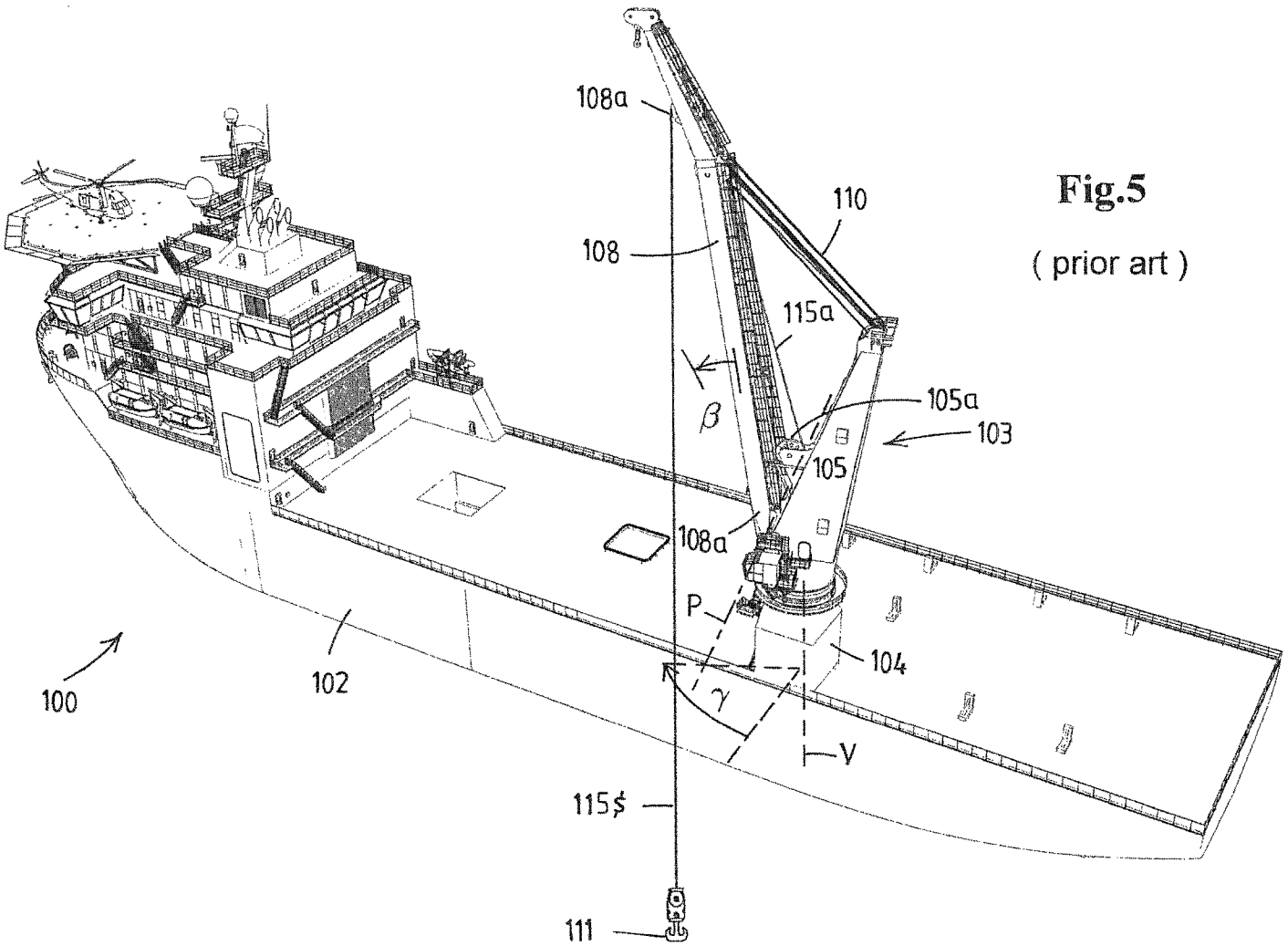
Fig.5 ( prior art )
FIG. 5 depicts a crane vessel according to the prior art in a perspective view.

In FIG. 5 a crane vessel 100 as known from the prior art is shown. Crane vessel 100 comprises a hull 102 and a crane 103. The shown crane vessel is a monohull vessel. The crane 103 comprises a stationary pedestal 4, which is mounted to or formed integral with the hull 102 of the crane vessel 100. The hull may be provided with a deck, onto which the pedestal may be mounted in an embodiment. Constructive advantages are possible when the pedestal is formed integral with the hull.

The crane 103 comprises a crane housing 105 that is adapted to slew relative to the pedestal 104 about a vertical rotation axis V. A slewing angle γ is schematically indicated in FIG. 1. The crane is furthermore provided with a boom 108, comprising an inner end 108*a* which is connected pivotably about a horizontal pivot axis P to the crane housing 105, allowing an up-and-down movement of the boom. A pivot angle β is schematically indicated in FIG. 1. The boom 108 is provided with a departing sheave 108*d*.

A luffing device 110 extends between the boom 108 and the crane housing 105, adapted to position the boom 108 and actuate the up-and-down movement of the boom.

It is noted that in an alternative embodiment, the pedestal of the crane is embodied as a fixed mast. In this embodiment, the crane housing is embodied as a rotating slew platform, adapted to slew relative to the mast about a vertical rotation axis, which pivotably supports the inner end of the boom, and a rotatable mast head at the top of the mast. The luffing device extends between the boom and the rotatable mast head to actuate the up-and-down movement of the boom.

Crane 103 further comprises an object suspension device, here embodied as a hook 111, to which the object that is to be lowered is connectable. The hook 111 is suspended from a hoisting cable 115 of a hoist assembly of the crane. The hoist assembly comprises a winch, which is not visible, but preferably provided in the pedestal 104 of the crane or inside the hull 102 of the vessel. The hoisting cable 115 extends from the winch, via a sheave 105*a* on the crane housing 105 and via the departing sheave 108*d* on the boom 108, to the hook 111. The portion of the hoist cable between the crane housing 105 and the boom is indicated with reference number 115*a*, and the portion of the hoist cable between the boom 108 and the object suspension device 111 forms a suspension cable part 115*s*.

The crane vessel of FIG. 1 is suitable to lower an object. The object (not shown) is preferably transported by the vessel and positioned on the hull of the vessel, optionally on deck. The lowering method comprises the following steps:

positioning the hook 111 above the object by slewing the crane housing and/or actuating the luffing cable and by actuating the hoisting cable 115, engaging the object by the hook 111 and actuating the hoist winch to lift the object, positioning the object in an overboard position by slewing the crane housing and/or actuating the luffing cable, lowering the object into the sea by actuating the hoist winch and as such elongating the suspension cable part 115*s*.

In FIGS. 6-9 the crane vessel of FIG. 1 is shown, furthermore provided with a hoist cable guide according to the first aspect of the present invention. The hoist cable guide is shown at an operational position thereof, guiding at least one of the suspension cable parts 115*s* between the boom 108 and the object suspension device 111. As the object has been lowered into the sea, the object and the object suspension device are no longer visible in FIGS. 6-9. In the operation position of the hoist cable guide, the hoist cable guide provides a point of engagement of the suspension cable part with the crane vessel, in addition to the engagement with the boom. Advantageously, the point of engagement created by the hoist cable guide according to the first aspect of the present invention is closer to the hull of the vessel, in particular closer to the motion center of the vessel, reducing the effect of sea state induced vessel motions, and point of engagement is lower, in particular closer to the center of gravity, thereby improving the stability of the crane vessel.

In all embodiments of FIGS. 6-9, the hoist cable guide is in its operational position, guiding at least one of the suspension cable parts. All shown hoist cable guides are positioned in vertical direction essentially between the horizontal pivot axis of the boom and the bottom of the hull, and in a direction transverse to the vessel within 5 meters of a side of the hull, and in longitudinal direction alongside the hull of the vessel. In particular, in FIGS. 6 and 7, the hoist cable guide is connected the hull of the vessel, and in FIGS. 8 and 9 the hoist cable guide is connected to the pedestal of the crane. Yet alternatively, as visible in FIG. 1G, the hoist cable guide is connected to the crane housing. Same parts are indicated with same numerals.

Figure 6:
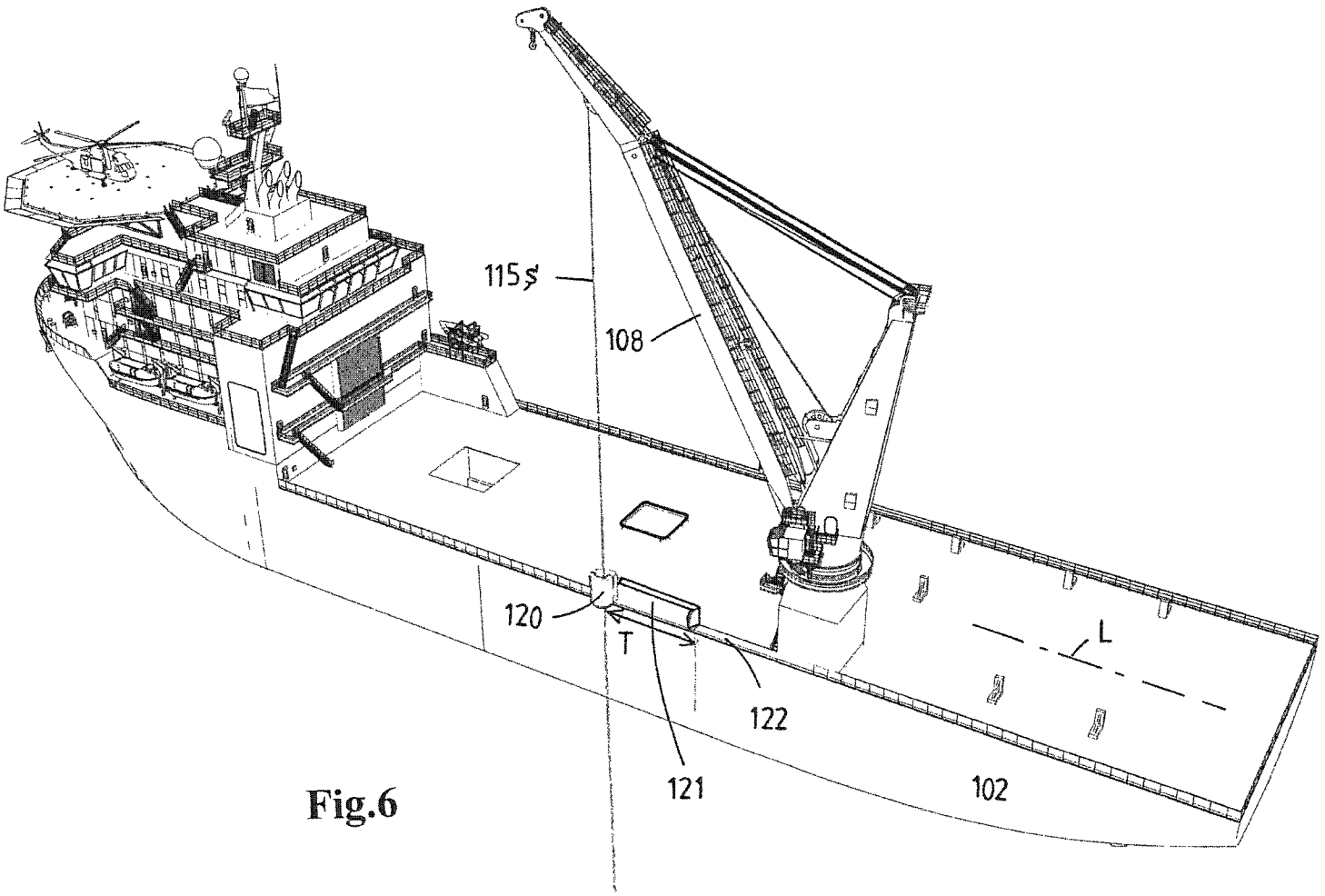
FIG. 6 depicts the crane vessel of FIG. 5, provided with a hoist cable guide according to the first aspect of the present invention.

In FIG. 6, a movable hoist cable guide 120 is shown. Hoist cable guide 120 is provided on a hoist cable guide carriage 121 engaging on a hoist cable guide track 122 which is provided along the hull 102 of the vessel and extending essentially parallel to the longitudinal axis L of the vessel. A hoist cable guide drive (not visible) is provided to translate the hoist cable guide carriage 120 along the hoist cable guide track 122 in a direction T. This embodiment comprising a movable hoist cable guide 120 allows the suspension cable part 115*s* to be brought into engagement with the hoist cable guide 120 by the following steps:

slewing the crane housing 105 such that the suspension cable part 115*s* of the hoisting cable moves towards the hull 102 of the vessel, until the suspension cable part is adjacent the hoist cable guide track 122, actuating the hoist cable guide drive to translate the hoist cable guide 120 until the hoist cable guide 120 reaches the suspension cable part 115*s*, engaging the suspension cable part with the hoist cable guide.

The position of the hoist cable guide 120 as shown in FIG. 6 may be an operational position of the hoist cable guide, in which position it is adapted to guide the suspension cable part 115*s*. It is also conceivable that the position of the hoist cable guide 120 as shown in FIG. 6 is an engagement position, remote from the operational position. The hoist cable guide drive is capable of moving the hoist cable guide 120 and the engaged suspension cable part from the engagement position to the operational position. Yet alternatively, it is conceivable that multiple operational positions of the hoist cable guide 120 exist, in all positions the hoist cable guide is adapted to guide the suspension cable part. In this embodiment, the hoist cable guide drive is adapted to move the hoist cable guide 120 and the engaged suspension cable part from one operational position to another operational position.

The hoist cable guide 120 as shown in FIG. 6 is of the type which is adapted to transform between an open configuration (not shown) allowing the suspension cable part to be brought in engagement with the hoist cable guide 120 and a closed configuration (as visible in FIG. 6) in which the suspension cable part is guided by the hoist cable guide 120, and cannot be removed from the hoist cable guide 120.

Figure 7:
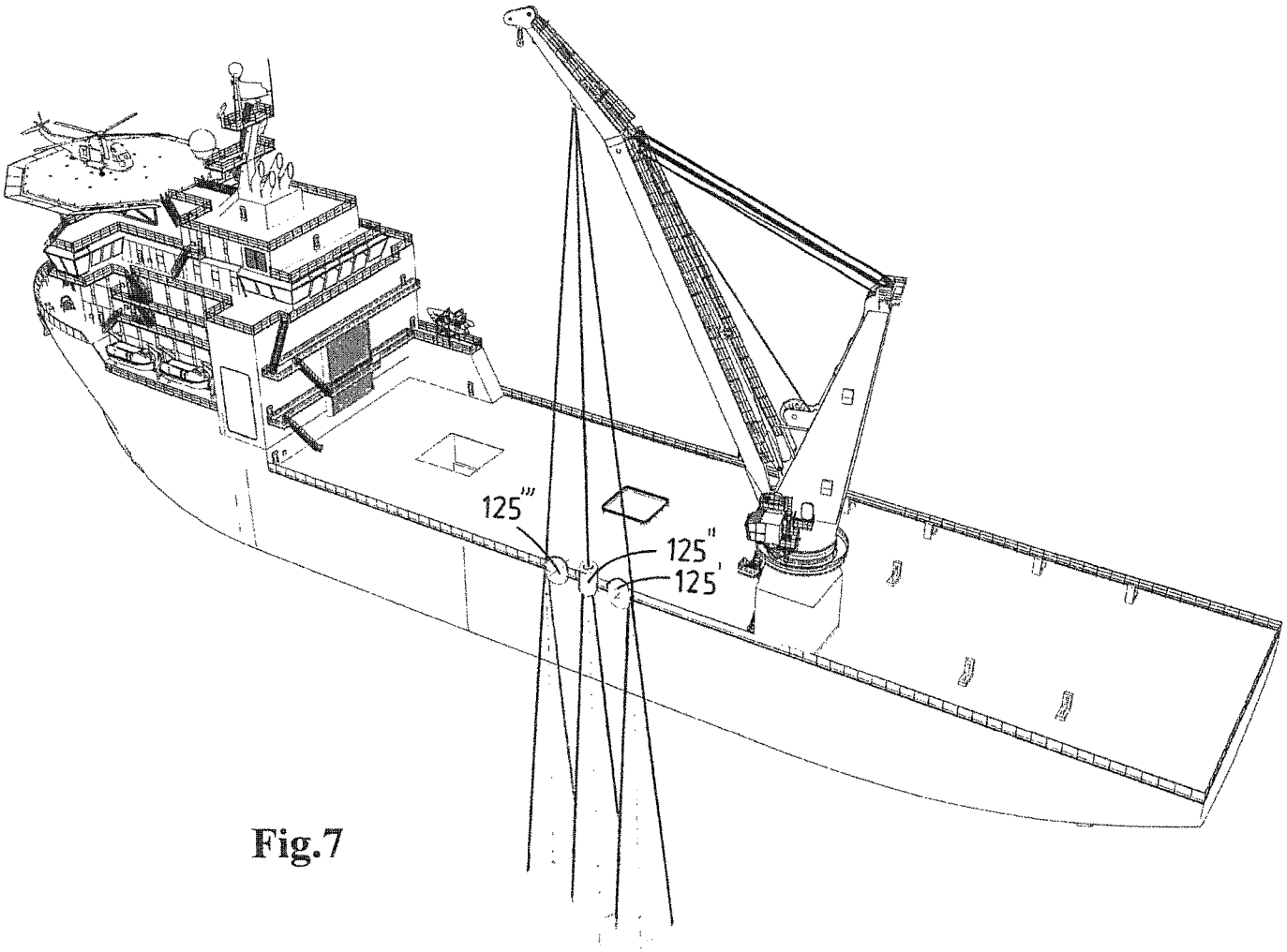
FIG. 7 depicts the crane vessel of FIG. 5, provided with alternative hoist cable guides according to the first aspect of the present invention.

In FIG. 7 three different embodiments of a hoist cable guide are shown schematically, indicated as 125', 125" and 125'". Hoist cable guide 125" is of the same configuration as hoist cable guide 120 of FIG. 6: adapted to transform between an open and a closed configuration. Yet alternatively, the hoist cable guide can be embodied as a sheave, such as hoist cable guides 125' and 125'". In this drawing, not only multiple hoist cable guides are shown, but also multiple operational positions of a hoist cable guide. In FIG. 7, it is visible that the suspension cable part 115*s* is guided at three different locations. Although not shown, similar to the embodiment of FIG. 5, the hoist cable guide 125', 125" or 125'" may be provided on a hoist cable guide carriage engaging on a hoist cable guide track which is provided along the hull of the vessel and extending essentially parallel to the longitudinal axis L of the vessel. A hoist cable guide drive may be provided to translate the hoist cable guide carriage along the hoist cable guide track.

Figure 8:
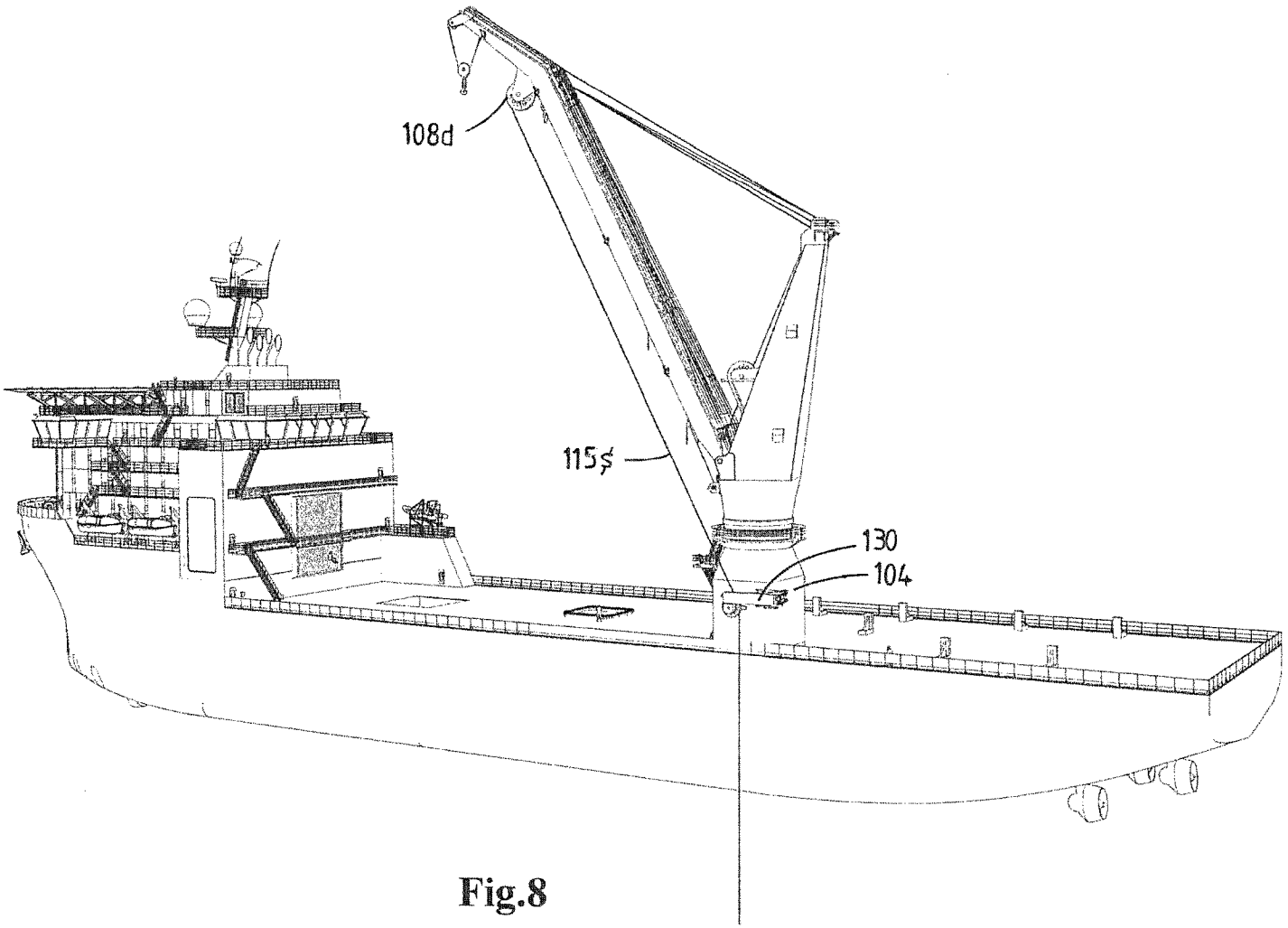
FIG. 8 depicts the crane vessel of FIG. 5, provided with yet an alternative hoist cable guide according to the first aspect of the present invention.
Figure 9:
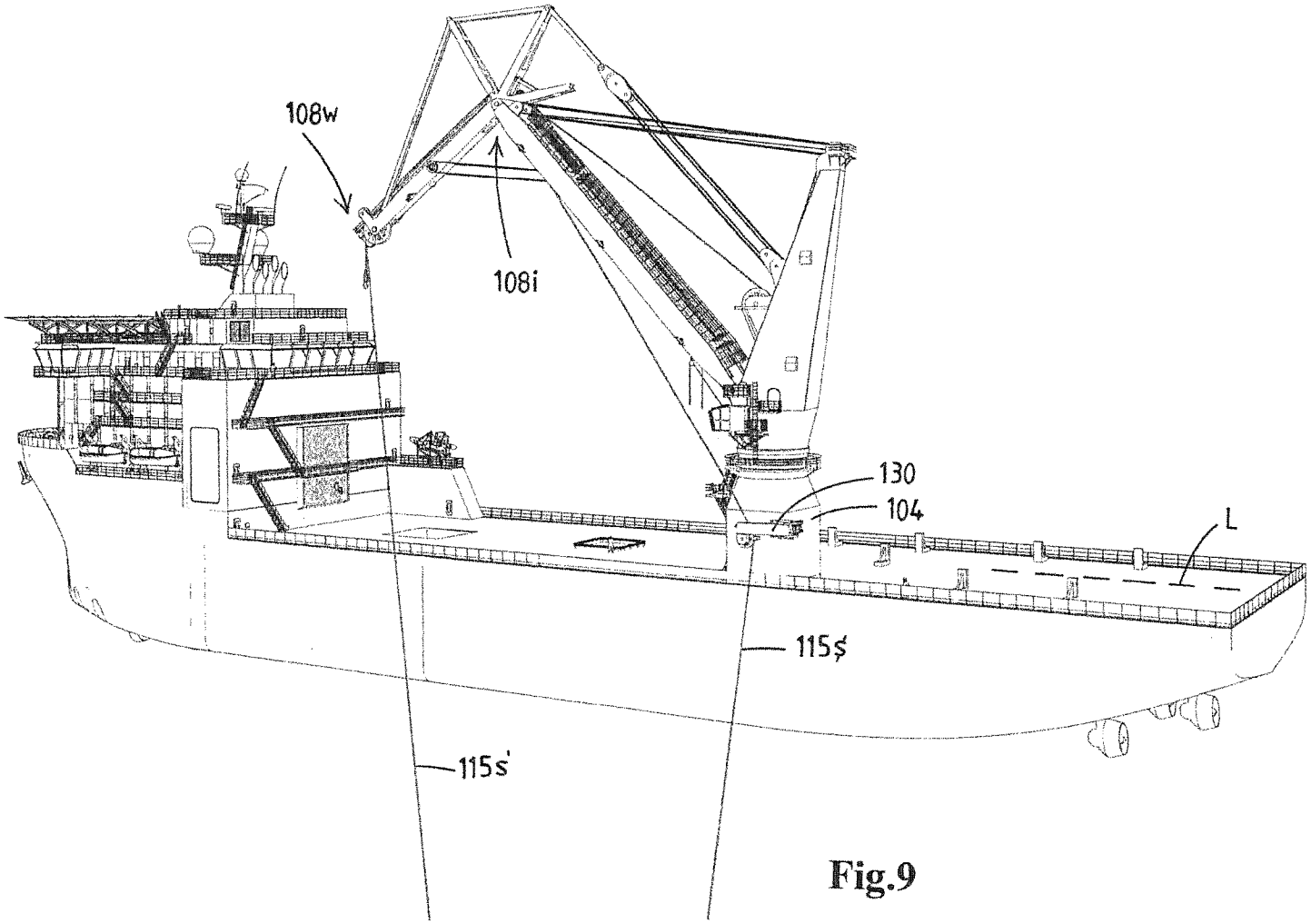
FIG. 9 depicts the crane vessel of FIG. 8, provided with an alternative hoist cable configuration according to the first and second aspect of the invention.

In FIGS. 8 and 9, yet an alternative cable guide hoist 130 is provided on the pedestal 104 of the crane, which is shown in the operational position guiding a suspension cable part 115*s*. In FIG. 8, the hoisting cable is provided as a single fall cable, and the hoist cable guide 130 at guides the suspension cable part 115*s* of the hoisting cable between the departing sheave 108*d* of the boom and the object suspension device. In FIG. 9, the hoisting cable is provided as a multiple fall cable which departs the boom at an radially inward location 108*i* and a radially outward location 108*w*, the hoisting cable comprising a first suspension cable part 115*s'* extending between the object suspension device and the radially outward location 108*w* of the boom, and one or more second suspension cable parts 115*s* extending between the objection suspension device and the radially inward location 108*i*. Hoist cable guide 130 guides the second suspension cable part 115*s*.

In a possible method, the suspension cable part 115*s* of the hoisting cable is brought into engagement with the hoist cable guide 130 by slewing the crane housing to a position wherein the boom extends above the hoist cable guide 130, i.e. perpendicular to the longitudinal axis L of the vessel in the shown embodiment, and subsequently actuating the luffing cable to move the boom upwards and thereby move the suspension cable part 115*s* which is to be engaged towards the hull of the vessel, and thus towards the hoist cable guide 130. Optionally, the hoist cable guide 130 is also movable. As such, the crane can move the suspension cable part close to the hoist cable guide, and movements of the hoist cable guide allow the suspension cable part and the hoist cable part to engage at an engagement position. This may be an operational position, or alternatively an optional subsequent movement of the hoist cable guide with the engaged suspension cable part may bring the hoist cable guide to its operational position.

In FIGS. 10*a*-10*e*, a portion of a crane vessel according to a possible embodiment of the first aspect of the invention is schematically shown in various views: from above in FIGS. 10*a*-10*c* and from aside in FIGS. 10*d* and 10*e*. The pedestal 104 is visible, as well as a portion of the hull 102 and water W. In this crane vessel, not only a hoist cable guide 135 is provided, but also a hoist cable receiver 140. The hoist cable receiver 140 is provided in the vicinity of the hoist cable guide 135, here a vertical distance below the hoist cable guide 140, as is visible in the side view of FIG. 10*e*. The hoist cable receiver 140 is adapted to receive the suspension cable part (not shown). Due to sea state induce vessel motions, the location of the suspension cable part, suspending from the boom in the vicinity of the hoist cable receiver 140, can frequently not be defined more precisely than within a certain circular range. This range wherein the suspension cable guide can be positioned by the crane, in particular by slewing the crane housing and/or actuating the luffing cable, is indicated with reference numeral 141 in FIG. 10*a*. The hoist cable receiver 140 furthermore allows the suspension cable part to slide to the hoist cable guide. Hence, once the suspension cable part is received by the hoist cable receiver, the suspension cable part may be moved by the crane, in particular by slewing the crane housing and/or actuating the luffing cable, and because the hoist cable receiver allows the suspension cable part to be slided along the hoist cable receiver, the suspension cable part can be slided right into the hoist cable guide.

The hoist cable receiver 140 comprises a funnel-shaped portion, here a triangular portion comprising a wide end 140*a* which is adapted to receive the suspension cable part, and an opposite narrow end 140*b* towards the suspension cable part can be slided towards the hoist cable guide 135.

In the shown embodiment, both the hoist cable guide 135 and the hoist cable receiver 140 are provided movable. In FIGS. 10*c* and 10*d*, the hoist cable receiver 140 is shown in a storage position, in which the hoist cable receiver is stored inside the hull 102 of the vessel. The hoist cable receiver 140 is movable by a hoist cable receiver drive, not shown in detail. The drive allows the hoist cable receiver 140 to be brought to a position in which the hoist cable receiver extends radially outwards with respect to the vertical rotation axis V of the crane housing.

The hoist cable guide 135 is also movable between a storage position, visible in FIG. 10*d*, and the operational position, visible in FIG. 10*a*, in particular the position indicated with reference numeral 135'.

This configuration allows the following procedure to bring the suspension cable part into engagement with the hoist cable guide:

- providing the hoist cable receiver 140 in an operational position, i.e. from the position of FIG. 10*c* to the position of FIG. 10*b;*
- slewing the crane housing and/or actuating the luffing cable to bring the suspension cable part of the hoisting cable into engagement with the hoist cable receiver, i.e. bring the circle 141 to the wide end 140*a* of the hoist cable receiver;
- actuating the luffing cable to slide the suspension cable part along the hoist cable receiver to the narrow end 140*b* of the hoist cable receiver
- providing the hoist cable guide 135 into the operation position, radially outward of the narrow end 140*b* of the hoist cable receiver,
- engaging the suspension cable part with the hoist cable guide 135.

In FIGS. 11*a*-11*d* various methods of bringing suspension cable part 151 of the hoisting cable into engagement with a hoist cable guide 152 are schematically indicated. The situation is always shown from a top view, in which the pedestal of the crane 104 is visible with the vertical rotation axis of the crane housing V. The slewing of the crane is indicated with an arrow 150. Furthermore, a portion of the hull 102 is visible and the water W. The translational movement of the suspension cable part which is achieved by pivoting the boom up and down is indicated with arrows 155.

Figure 11A:
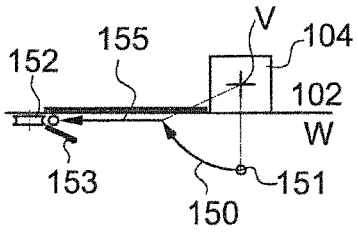
Figure 11B:
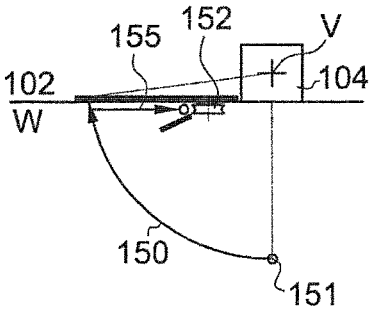

In FIGS. 11*a* and 11*b*, a hoist cable receiver 153 is provided, having a longitudinal axis extending essentially along the hull 102 of the vessel. The suspended cable part 151 is brought into engagement with the hoist cable receiver 153 by slewing motion 150. Subsequently, the suspended cable part is allowed to slide along the hoist cable receiver 153 in direction 155 by pivoting the boom, to come into engagement with the stationary provided hoist cable guide 152. In FIGS. 11*a* and 11*b*, directions 155 are oppositely oriented.

Figure 11C:
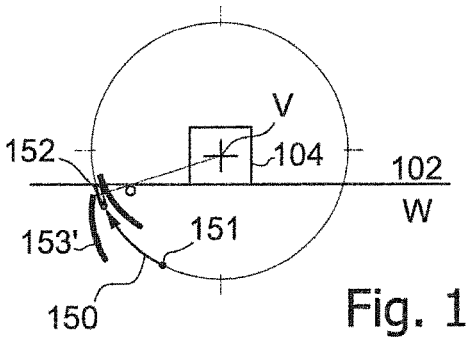

In FIG. 11*c*, a hoist cable receiver 153' is provided, having a longitudinal axis extending essentially perpendicular to the hull 102 of the vessel. The suspended cable part 151 is brought into engagement with the hoist cable receiver 153' by slewing motion 150, and the suspended cable part is subsequently allowed to slide along the hoist cable receiver 153', to come into engagement with a stationary provided hoist cable guide 152 (not shown in detail).

Figure 11D:
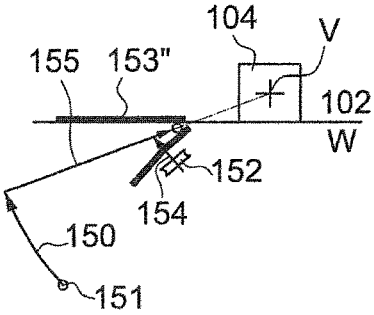

In FIG. 11*d*, a hoist cable receiver 153" is provided, having a longitudinal axis extending essentially along the hull 102 of the vessel, similar to the embodiment of FIG. 11 *b*. The suspended cable part 151 is brought into the reach area of the hoist cable receiver 153" by slewing motion 150. Subsequently, the suspended cable part is allowed towards the hoist cable receiver, to be received by the receiver and subsequently slide along the hoist cable receiver 153 in direction 155 by pivoting the boom. As such, the suspended cable part is brought to a known position in the hoist cable receiver 153". In the shown embodiment, the hoist cable guide 152 is movable in a direction 154 towards the position of the suspended cable part in the hoist cable receiver 153".

In FIGS. 12*a* and 12*b*, alternative embodiments of a hoist cable guide 160 and 160' respectively are shown, in combination with alternative embodiments of a hoist cable receiver 165 and 165' respectively. Suspension cable part 166 is moved by the crane to come into contact with a hoist cable receiver, and slided by the hoist cable receiver towards the hoist cable guide. To prevent the suspended cable part from disengaging from hoist cable guide, the suspended cable part is preferably engaged in all directions. In FIG. 12*a*, this is accomplished in that the suspended cable part 166 in the operational position of the hoist cable guide 160 is engaged by both the hoist cable receiver 165 and the hoist cable guide 160. In FIG. 12*b*, this is accomplished in that the suspended cable part 166 is guided by the hoist cable guide 16' in the operational position thereof in a closed configuration, in which the suspension cable part cannot be removed from the hoist cable guide.

In FIG. 13, a schematical cross-section of such a hoist cable receiver 160' of FIG. 12*b* is visible.

The invention claimed is:

1. A crane vessel comprising a hull and a crane, wherein the crane comprises:

a stationary pedestal, mounted to or formed integral with the hull of the crane vessel;

a crane housing that is adapted to slew relative to the pedestal about a vertical rotation axis;

a boom, comprising an inner end which is connected pivotably about a horizontal pivot axis to the crane housing, allowing an up-and-down movement of the boom, and comprising a departing sheave;

a luffing device extending between the boom and the crane housing, adapted to position the boom and actuate the up-and-down movement of the boom;

an object suspension device to which an object is connectable; and a hoist assembly which comprises a winch and an associated hoisting cable, the hoisting cable extending from the winch, via a departing sheave on the boom, to the object suspension device, such that upon actuation of the winch the object suspension device is raised and lowered, wherein the one or more portions of the hoist cable between the boom and the object suspension device form one or more suspension cable parts, wherein the crane vessel is furthermore provided with a hoist cable guide which, at an operational position thereof, is adapted to guide at least one of the suspension cable parts between the boom and the object suspension device, wherein in the operational position, the hoist cable guide is connected to the pedestal of the crane, the crane housing or the hull of the vessel, and wherein in the operational position, the hoist cable guide is positioned in a direction transverse to the vessel within 5 meters of a side of the hull.

2. The crane vessel according to claim 1, wherein the hoisting cable is provided as one suspension cable part, and wherein the hoist cable guide at the operational position thereof is adapted to guide a suspension cable part of the one or more suspension cable parts of the hoisting cable between the departing sheave of the boom and the object suspension device.

3. The crane vessel according to claim 1, wherein the hoisting cable is provided as two or more suspension cable parts comprising one or more first suspension cable parts extending between the object suspension device and a radially outward location of the boom, and one or more second suspension cable parts extending between the objection suspension device and a radially inward location of the boom, wherein the hoist cable guide, at the operational position thereof, is adapted to guide the one or more second suspension cable parts.

4. The crane vessel according to claim 1, wherein in the operational position the hoist cable guide is positioned in vertical direction between the horizontal pivot axis of the boom and the bottom of the hull, and in longitudinal direction alongside the hull of the vessel.

5. The crane vessel according to claim 1, wherein the hoist cable guide is adapted to transform between an open configuration allowing at least one suspension cable part of the one or more suspension cable parts to be brought in engagement with the hoist cable guide and a closed configuration in which the at least one suspension cable part of the one or more suspension cable parts is guided by the hoist cable guide, and is unremovable from the hoist cable guide.

6. The crane vessel according to claim 1, wherein the hoist cable guide is movable relative to the hull of the vessel.

7. The crane vessel according to claim 6, further comprising a hoist cable guide drive, which is adapted to move the hoist cable guide to an engagement position, remote from the operational position, and the hoist cable guide drive is also adapted to move the hoist cable guide and the engaged suspension cable part from the engagement position to the operational position.

8. The crane vessel according to claim 6, wherein the hoist cable guide is provided on a hoist cable guide carriage engaging on a hoist cable guide track which is provided along the hull of the vessel and extending parallel to the longitudinal axis of the vessel, wherein a hoist cable guide drive is adapted to translate the hoist cable guide carriage along the hoist cable guide track.

9. The crane vessel according to claim 1, wherein in the vicinity of the hoist cable guide a hoist cable receiver is provided, the hoist cable receiver is adapted to receive the suspension cable part and allows the suspension cable part to slide to the hoist cable guide.

10. The crane vessel according to claim 9, wherein the hoist cable receiver comprises a funnel-shaped portion, comprising a wide end which is adapted to receive at least one suspension cable part of the one or more suspension cable parts, and an opposite narrow end which is provided in the vicinity of the hoist cable guide.

11. The crane vessel according to claim 9, wherein the hoist cable receiver extends radially with respect to the vertical rotation axis of the crane housing.

12. The crane vessel according to claim 9, wherein the hoist cable receiver is movable by a hoist cable receiver drive.

13. A method of lowering an object from a crane vessel into the sea, the crane vessel comprising a hull and a crane, wherein the crane comprises:

a stationary pedestal, mounted to or formed integral with the hull of the vessel;

a crane housing that is adapted to slew relative to the pedestal about a vertical rotation axis;

a boom, comprising an inner end which is connected pivotably about a horizontal pivot axis to the crane housing, allowing an up-and-down movement of the boom, and comprising a departing sheave;

a luffing device extending between the boom and the crane housing, adapted to position the boom and actuate the up-and-down movement of the boom;

an object suspension device to which the object is connectable; and a hoist assembly which comprises a winch and an associated hoisting cable, the hoisting cable extending from the winch, via a departing sheave on the boom, to the object suspension device, such that upon actuation of the winch the object suspension device is raised and lowered, wherein the portion of the hoist cable between the boom and the object suspension device forms one or more suspension cable parts, wherein the crane vessel is furthermore provided with a hoist cable guide which, at an operational position thereof, is adapted to guide at least one of the suspension cable parts of the one or more suspension cable parts between the boom and the object suspension device, wherein the method comprises the following steps:

positioning the object suspension device above the object;

engaging the object by the object suspension device and actuating the hoist winch to lift the object;

positioning the object in an overboard position by slewing the crane housing and/or actuating the luffing cable;

lowering the object into the sea by actuating the hoist winch;

bringing a suspension cable part of the one or more suspension cable parts into engagement with the hoist cable guide; and guiding the phrase the at least one of the suspension cable parts of the one or more suspension cable parts by the hoist cable guide in the operational position of the hoist cable guide, wherein in the operational position, the hoist cable guide is connected to the pedestal of the crane, the crane housing or the hull of the vessel, and wherein in the operational position, the hoist cable guide is positioned in a direction transverse to the vessel within 5 meters of a side of the hull.

14. The method according to claim 13, comprising the step of slewing the crane housing and/or actuating the luffing cable to bring the suspension cable part of the one or more suspension cable parts into engagement with the hoist cable guide.

15. The method according to claim 13, wherein the hoist cable guide is movable and wherein the suspension cable part of the one or more suspension cable parts is brought into engagement with the hoist cable guide by moving the hoist cable guide.

16. The method according to claim 13, further comprising a hoist cable guide drive, which is adapted to move the hoist cable guide to an engagement position, remote from the operational position, and which is also adapted to move the hoist cable guide and the suspension cable part of the one or more suspension cable parts from the engagement position to the operational position, wherein the suspension cable part of the one or more suspension cable parts is brought into engagement with the hoist cable guide by:

actuating the hoist cable guide drive to move the hoist cable guide to the engagement position until the hoist cable guide reaches the suspension cable part of the one or more suspension cable parts;

engaging the suspension cable part of the one or more suspension cable parts with the hoist cable guide; and moving the hoist cable guide and the suspension cable part of the one or more suspension cable parts from the engagement position to the operational position.

17. The method according to claim 13, wherein the hoist cable guide is provided on a hoist cable guide carriage engaging on a hoist cable guide track which is provided along the hull of the vessel and extending parallel to the longitudinal axis of the vessel, wherein a hoist cable guide drive is adapted to translate the hoist cable guide carriage along the hoist cable guide track, and wherein the hoisting cable is brought into engagement with the hoist cable guide by:

slewing the crane housing such that the suspension cable part of the one or more suspension cable parts moves towards the hull of the vessel, until the suspension cable part of the one or more suspension cable parts is adjacent the hoist cable guide track;

actuating the hoist cable guide drive to translate the hoist cable guide until the hoist cable guide reaches the suspension cable part of the one or more suspension cable parts; and engaging the suspension cable part of the one or more suspension cable parts with the hoist cable guide.

18. The method according to claim 13 wherein in the vicinity of the hoist cable guide an elongated hoist cable receiver is provided, which is adapted to receive the suspension cable part of the one or more suspension cable parts and allows the suspension cable part to slide to the hoist cable guide, wherein the suspension cable part is brought into engagement with the hoist cable guide by:

providing the hoist cable receiver in an operational position;

slewing the crane housing and/or actuating the luffing cable to bring the suspension cable part of the one or more suspension cable parts into engagement with the hoist cable receiver;

slewing the crane housing and/or actuating the luffing cable to slide the suspension cable part of the one or more suspension cable parts along the hoist cable receiver to the hoist cable guide; and engaging the suspension cable part of the one or more suspension cable parts with the hoist cable guide.

19. A method of lowering an object from a crane vessel into the sea, wherein use is made of a crane vessel comprising a hull and a crane, wherein the crane comprises:

a stationary pedestal, mounted to or formed integral with the hull of the crane vessel;

a crane housing that is adapted to slew relative to the pedestal about a vertical rotation axis;

a boom, comprising an inner end which is connected pivotably about a horizontal pivot axis to the crane housing, allowing an up-and-down movement of the boom, and comprising a departing sheave;

a luffing device extending between the boom and the crane housing, adapted to position the boom and actuate the up-and-down movement of the boom;

an object suspension device to which an object is connectable; and a hoist assembly which comprises a winch and an associated hoisting cable, the hoisting cable extending from the winch, via a departing sheave on the boom, to the object suspension device, such that upon actuation of the winch the object suspension device is raised and lowered, wherein the one or more portions of the hoist cable between the boom and the object suspension device form one or more suspension cable parts, and wherein the hoisting cable is provided as a multiple fall cable, wherein a hoist cable retention device is provided on the boom, and the hoisting cable comprises one or more first suspension cable parts extending between the object suspension device and a radially outward location of the boom, and one or more second suspension cable parts extending between the objection suspension device and the hoist cable retention device which is in a different location from said radially outward location of the boom, such that the first and second suspension cable parts extend at V-shape with respect to each other, and wherein an angle between the first and second suspension cable parts is adjustable, at a given position of the inner end of the boom and the object suspension device;

said method comprising the following steps:

positioning the object suspension device above the object;

engaging the object by the object suspension device and actuating the hoist winch to lift the object;

positioning the object in an overboard position by slewing the crane housing and/or actuating the luffing cable;

lowering the object into the sea by actuating the hoist winch; and enlarging the angle between the first and second suspension cable parts.

20. The method according to claim 19, wherein the crane vessel is furthermore provided with a hoist cable guide which, at an operational position thereof, is adapted to guide at least one of the second suspension cable parts between the boom and the object suspension device, and wherein the angle between the first and second suspension cable parts is enlarged by bringing a suspension cable part of the hoisting cable into engagement with the hoist cable guide, and subsequently guiding at least one of the suspension cable parts by the hoist cable guide in the operational position of the hoist cable guide.

21. The method according to claim 19, wherein the hoist cable retention device is provided on a trolley which is allowed to move along the boom, thereby changing an angle between the first and second suspension cable parts, and wherein the angle between the first and second suspension cable parts is enlarged by moving the trolley along the boom.

22. The method according to claim 19, wherein the radially outward location of the boom and the hoist cable retention device are located at two ends of a jib, one of the two ends of the jib, at which the hoist cable retention device is located, is pivotably connected to an outer end, opposite to the inner end, of the boom about another horizontal pivot axis to the crane housing, and a pivoting movement of the jib with respect to the boom adjusts the angle between the first and second suspension cable parts with respect to the given position of the inner end of the boom and the object suspension device.

* * * * *